US009534603B2

(12) United States Patent
St. John et al.

(10) Patent No.: US 9,534,603 B2
(45) Date of Patent: Jan. 3, 2017

(54) APPARATUS AND SYSTEM FOR A THRUST-ABSORBING HORIZONTAL SURFACE PUMP ASSEMBLY

(71) Applicant: Summit ESP, LLC, Tulsa, OK (US)

(72) Inventors: Brent David St. John, Owasso, OK (US); Ryan Michael Nicholson, Broken Arrow, OK (US); David Lunk, Big Cabin, OK (US); Larry James Parmeter, Broken Arrow, OK (US); Brett Leamy, Claremore, OK (US); Keith Leon Johnson, Claremore, OK (US); John Vanderstaay Kenner, Houston, TX (US); Thomas John Gottschalk, Houston, TX (US)

(73) Assignee: Summit ESP, LLC, Tulsa, OK (US)

( * ) Notice: Subject to any disclaimer, the term of this patent is extended or adjusted under 35 U.S.C. 154(b) by 0 days.

(21) Appl. No.: 14/677,559

(22) Filed: Apr. 2, 2015

(65) Prior Publication Data

US 2015/0211527 A1 Jul. 30, 2015

Related U.S. Application Data

(63) Continuation-in-part of application No. 14/657,835, filed on Mar. 13, 2015, which is a continuation of
(Continued)

(51) Int. Cl.
*F04D 13/10* (2006.01)
*F04D 29/047* (2006.01)
(Continued)

(52) U.S. Cl.
CPC ..... *F04D 13/10* (2013.01); *F04D 7/04* (2013.01); *F04D 13/086* (2013.01);
(Continued)

(58) Field of Classification Search
CPC ..... F04D 29/04; F04D 29/08; F04D 29/086; F04D 29/106; F04D 29/041; F04D 29/0413; F04D 13/08
See application file for complete search history.

(56) References Cited

U.S. PATENT DOCUMENTS 2,363,420 A 11/1944 Howard
2,926,970 A 3/1960 Clark
(Continued)

FOREIGN PATENT DOCUMENTS

BR PI9400686-5 A 10/1995
BR PI9400687-3 A 10/1995
(Continued)

OTHER PUBLICATIONS

Nowacki, J.et al., "Microstructure and characteristics of high dimension brazed joints of cermets and steel," Journal of Achievements in Materials and Manufacturing Engineering, Dec. 2009, vol. 37, Issue 2, 448-457, 10 pages.
(Continued)

*Primary Examiner* — Devon Kramer
*Assistant Examiner* — Kenneth J Hansen
(74) *Attorney, Agent, or Firm* — Frederic Dorwart, Lawyers; Penina Michlin Chiu

(57) ABSTRACT

An apparatus and system for a thrust-absorbing horizontal surface pump assembly is described. A thrust-absorbing horizontal surface pump system includes an intake chamber including a stationary thrust bearing paired with a rotatable thrust runner to form a thrust bearing set, wherein a first face of the stationary thrust bearing positioned towards the rotatable thrust runner is at least partially diamond-coated, and wherein a second face of the rotatable thrust runner positioned towards the stationary thrust bearing is at least partially diamond-coated, a fluid entrance that receives a
(Continued)

fluid into the intake chamber, and a pump inlet that receives the fluid into the multi-stage centrifugal pump, wherein the thrust bearing set is arranged around the intake shaft such that during operation of the electric motor the thrust bearing is in a pathway of the fluid as the fluid flows between the fluid entrance and the pump inlet.

25 Claims, 23 Drawing Sheets

Related U.S. Application Data application No. 14/274,233, filed on May 9, 2014, now Pat. No. 9,017,043.

(60) Provisional application No. 61/974,907, filed on Apr. 3, 2014, provisional application No. 61/822,085, filed on May 10, 2013, provisional application No. 61/974,907, filed on Apr. 3, 2014.

(51) Int. Cl.
*F04D 29/041* (2006.01)
*F04D 7/04* (2006.01)
*F04D 13/08* (2006.01)

(52) U.S. Cl.
CPC ..... *F04D 29/041* (2013.01); *F04D 29/047* (2013.01); *F04D 29/0413* (2013.01)

(56) References Cited

U.S. PATENT DOCUMENTS

| | | | | |
|---|---|---|---|---|
| 3,267,869 | A | 8/1966 | Vartapetov et al. | |
| 3,384,026 | A | 5/1968 | Williamson, Jr. | |
| 3,404,924 | A | 10/1968 | Choate | |
| 3,424,372 | A | 1/1969 | Blattner et al. | |
| 5,160,240 | A | 11/1992 | Wilson | |
| 5,207,810 | A * | 5/1993 | Sheth | B04B 5/12 166/105.5 |
| 5,287,612 | A | 2/1994 | Paddock et al. | |
| 5,320,431 | A * | 6/1994 | Kallenberger | B61F 15/02 384/322 |
| 5,344,291 | A | 9/1994 | Antkowiak | |
| 5,367,214 | A | 11/1994 | Turner, Jr. | |
| 5,379,519 | A | 1/1995 | Paddock et al. | |
| 5,404,061 | A | 4/1995 | Parmeter | |
| 5,667,314 | A | 9/1997 | Limanowka et al. | |
| 5,765,950 | A | 6/1998 | Eno et al. | |
| 5,769,617 | A | 6/1998 | Glen | |
| 6,017,184 | A | 1/2000 | Aguilar et al. | |
| 6,196,813 | B1 | 3/2001 | Turley et al. | |
| 6,309,174 | B1 * | 10/2001 | Oklejas, Jr. | F04D 1/06 415/104 |
| 6,425,735 | B1 | 7/2002 | Sheth | |
| 6,450,782 | B1 | 9/2002 | Sakamoto | |
| 6,461,115 | B1 | 10/2002 | Ferrier et al. | |
| 6,592,985 | B2 | 7/2003 | Griffin et al. | |
| 7,104,766 | B2 | 9/2006 | Mascola | |
| 7,549,849 | B2 | 6/2009 | Watson et al. | |
| 7,575,413 | B2 | 8/2009 | Semple et al. | |
| 7,665,975 | B2 | 2/2010 | Parmeter et al. | |
| 7,921,908 | B2 | 4/2011 | Tetzlaff et al. | |
| 7,987,913 | B2 | 8/2011 | Parmeter et al. | |
| 8,016,571 | B2 * | 9/2011 | Speer | F04D 1/063 384/420 |
| 8,070,426 | B2 | 12/2011 | Brunner et al. | |
| 8,246,251 | B1 | 8/2012 | Gardner | |
| 8,277,124 | B2 | 10/2012 | Sexton et al. | |
| 8,529,222 | B2 | 9/2013 | Burns et al. | |
| 9,017,043 | B2 | 4/2015 | Parmeter et al. | |
| 2004/0057642 | A1 | 3/2004 | New | |
| 2005/0087343 | A1 | 4/2005 | Du et al. | |
| 2006/0269178 | A1 | 11/2006 | Mascola | |
| 2007/0207046 | A1 | 9/2007 | Du et al. | |
| 2007/0277969 | A1 | 12/2007 | Hall et al. | |
| 2010/0288558 | A1 * | 11/2010 | Sexton | E21B 4/003 175/92 |
| 2011/0014071 | A1 | 1/2011 | Du et al. | |
| 2011/0024198 | A1 | 2/2011 | Dick et al. | |
| 2013/0319956 | A1 | 12/2013 | Tetzlaff et al. | |

FOREIGN PATENT DOCUMENTS

| | | | |
|---|---|---|---|
| EP | 0877165 | A2 | 11/1998 |
| JP | 04027800 | A | 1/1992 |

OTHER PUBLICATIONS

Takacs, Gabor, "Use of ESP Equipment in Special Conditions," Electrical Submersible Pumps Manual: Design, Operations, and Maintenance, 2009, Gulf Professional Publishing, Burlington, MA, 163, 2 pages.

* cited by examiner

APPARATUS AND SYSTEM FOR A THRUST-ABSORBING HORIZONTAL SURFACE PUMP ASSEMBLY

CROSS REFERENCE TO RELATED APPLICATIONS

This application claims the benefit of U.S. Provisional Application No. 61/974,907 to Lunk et al., filed Apr. 3, 2014 and entitled "APPARATUS, SYSTEM AND METHOD FOR A HYDRODYNAMIC THRUST BEARING FOR USE IN HORIZONTAL PUMP ASSEMBLIES," which is hereby incorporated by reference in its entirety. This application is a continuation-in-part of U.S. application Ser. No. 14/657,835 to Parmeter et al., filed Mar. 13, 2015 and entitled APPARATUS AND SYSTEM FOR SEALING SUBMERSIBLE PUMP ASSEMBLIES, which is a continuation of U.S. Ser. No. 14/274,233 to Parmeter et al., filed May 9, 2014 and entitled APPARATUS AND SYSTEM FOR SEALING SUBMERSIBLE PUMP ASSEMBLIES, which claims the benefit of U.S. Provisional Application No. 61/822,085 to Parmeter et al., filed May 10, 2013 and entitled "APPARATUS, SYSTEMS AND METHODS FOR SEALING SUBMERSIBLE PUMP ASSEMBLIES," and U.S. Provisional Application No. 61/974,907 to Lunk et al., filed Apr. 3, 2014 and entitled "APPARATUS, SYSTEM AND METHOD FOR A HYDRODYNAMIC THRUST BEARING FOR USE IN HORIZONTAL PUMP ASSEMBLIES," which are each hereby incorporated by reference in their entireties.

BACKGROUND OF THE INVENTION

1. Field of the Invention

Embodiments of the invention described herein pertain to the field of horizontal surface pumps. More particularly, but not by way of limitation, one or more embodiments of the invention enable an apparatus and system for a thrust-absorbing horizontal surface pump assembly.

2. Description of the Related Art

Submersible pump assemblies are typically used to artificially lift fluid to the surface in deep wells such as oil, water or gas wells. Additionally, in some instances, fluids must be pressurized and moved between surface locations and/or transported through a supply line to a tank. For example, it may be desirable to transport produced oil to a processing facility located remotely from the well. In such circumstances, submersible pumps may be used as surface pumps in horizontal pumping systems. Horizontal surface pump assemblies are also used for salt water disposal, water injection and other fluid transfer applications. Horizontal pumping assemblies typically include a multistage centrifugal pump horizontally mounted to a skid and driven by an electric motor, the pump assembly components are connected together by rotating shafts. The electric motor turns the shafts, which operates the pump. Horizontal pumps operate at rotational speeds of between 1800 and 3600 RPM, which requires the pump to be capable of bearing high axial loads, for example ranging from about 4,000 to 6,000 pounds in systems making use of roller element bearings.

To handle the thrust of the pump, a standalone thrust chamber is conventionally placed in between the motor and the intake of the horizontal pump assembly. Thrust bearings in the thrust chamber are submerged in a cavity of clean motor oil, carrying the thrust of the pump and maintaining shaft alignment. A conventional horizontal surface pump assembly including a standalone, motor-oil cooled thrust chamber is illustrated in FIG. 1. As shown in FIG. 1, conventional standalone thrust chamber 1 is between conventional surface motor 2 and conventional intake 6 of conventional pump 3.

In thrust chambers of horizontal surface pumps, such as conventional standalone thrust chamber 1, hydrodynamic bearings and roller element bearings are the most commonly implemented thrust bearings. However, roller element bearings are not well suited for horizontal surface pump applications because they wear out too quickly due to the high rotational speeds and loads to which the horizontal pumps are subjected, and they generate too much heat due to oil sheer.

Conventional hydrodynamic bearings also suffer from drawbacks. One drawback is that conventional bearings often do not include sufficient surface area to carry the loads required of horizontal surface pumps. The rotating disk of a hydrodynamic thrust bearing is typically a hard material such as tungsten carbide. The stationary disk typically includes softer metal pads made of bronze. However, bronze is only capable of carrying a load of about 500 pounds per square inch. There is often insufficient space to include large enough copper pads on the stationary disk to carry the required loads.

Another significant drawback to conventional hydrodynamic bearings is that conventional hydrodynamic bearings cannot withstand contamination (e.g., by dirt) of the motor oil in the thrust chamber. As a result, conventional hydrodynamic bearings must be placed in a cavity of clean motor oil, which is located in conventional thrust chamber 1 of a horizontal surface pump assembly. However, contamination of the cavity of clean motor oil is a common occurrence due to typical oil field or other operating conditions. Thus, motor oil-cooled thrust chambers, such as conventional thrust chamber 1, require regular maintenance such as oil changes. In addition, if a bearing failure occurs, for example due to contaminated motor oil in the chamber, the entire thrust chamber of a conventional horizontal pump assembly must be replaced, which is time consuming and expensive.

A conventional hydrodynamic bearing includes two round disks. One disk is fixed, while the other is turned by the shaft in rotation about the central axis of the fixed disk. A conventional fixed disk of the prior art is illustrated in FIGS. 2A and 2B. In some approaches, as illustrated in FIGS. 2A and 2B, the conventional fixed disk is designed with conventional copper pads. The flat, rotating disk pulls motor oil between the conventional pads. As long as there is clean motor oil between the surfaces, the thin film of fluid creates separation between the disks with hydrodynamic lift. On a conventional rotating disk, a solid surface is required on which the conventional pads rotate. Each pad deflects ever so slightly such that a wedge is formed at the leading edge. The leading edge is convergent, the trailing edge is divergent. The wedge produces a hydrodynamic profile that provides lift. The conventional pads and rotating disk must never make contact with each other or a catastrophic failure will occur. As a result, extreme pressure additives are added to the motor oil in the standalone thrust chamber. Additives provide a boundary layer of protection to prevent direct face contact until a wedge is formed. To function properly, the surfaces of hydrodynamic bearings must be flat and smooth. A typical hydrodynamic thrust bearing is usually designed to operate with a fluid thickness of between about 0.001 and 0.0004 inches. Any impurities that are thicker than the oil film between the disks, such as the common occurrence of dirt in the motor oil, can cause surface damage to the bearings. Resulting friction between the disks reduces or eliminates their hydrodynamic properties.

Thus, conventional horizontal surface pumps are not well suited to carry thrust under typical operating conditions and are expensive and time consuming to maintain and repair. Therefore, there is a need for an apparatus and system for a thrust-absorbing horizontal surface pump assembly.

BRIEF SUMMARY OF THE INVENTION

One or more embodiments of the invention enable an apparatus and system for a thrust-absorbing horizontal surface pump assembly.

An apparatus and system for a thrust-absorbing horizontal surface pump assembly are described. An illustrative embodiment of a thrust-absorbing horizontal surface pump assembly comprises a horizontally-mounted electric submersible pump, the electric submersible pump comprising a fluid inlet, a motor operatively coupled to the electric submersible pump so as to turn the pump, an intake section extending between the electric submersible pump and the motor, wherein the intake section comprises a fluid entrance and an intake shaft, wherein the intake shaft is rotatably coupled to a motor shaft on a first side and an electric submersible pump shaft on a second side, the intake section comprising a thrust bearing set exposed to a flow of pumped fluid, the thrust bearing set comprising a stationary thrust bearing secured to a chamber base of the intake section, the stationary thrust bearing comprising a first diamond-coated pad secured by a first locking plate, and a thrust runner paired with the stationary thrust bearing, wherein the thrust runner rotates with the intake shaft, the thrust runner comprising a second diamond-coated pad secured by a second locking plate. In some embodiments, the flow of pumped fluid flows from the fluid entrance of the intake section to the fluid inlet of the electric submersible pump. In some embodiments, the stationary thrust bearing comprises a first plurality of first diamond-coated pads arranged circumferentially around the first locking plate and the thrust runner comprises a second plurality of second diamond-coated pads arranged circumferentially around the second locking plate. In certain embodiments, the thrust runner comprises a base keyed to the intake shaft, and wherein the locking plate is secured to the base. In some embodiments, one of the first diamond-coated pad, the second diamond coated pad or a combination thereof has a disc-shaped profile. In certain embodiments, the intake section further comprises a first rotatable sleeve keyed to the intake shaft between the thrust bearing set and the motor, and a first stationary bushing paired with the first sleeve to form a radial support bearing set, a second radial support bearing set positioned between the thrust bearing set and the electric submersible pump, the second radial support bearing set comprising a second rotatable sleeve keyed to the intake shaft between the thrust bearing set and the electric submersible pump, a second stationary bushing paired with the second sleeve, and a spider bearing fixedly coupled between a housing of the intake and the second stationary bushing. In some embodiments, the thrust bearing set and the first radial support bearing set are fluidly coupled by bypass fluid and the bypass fluid is from a mechanical seal flush.

An illustrative embodiment of a thrust-absorbing horizontal surface pump system comprises an intake chamber between a multi-stage centrifugal pump and an electric motor, wherein the intake chamber, multi-stage centrifugal pump and electric motor are horizontally aligned on a surface, and wherein the centrifugal pump moves a fluid, the intake chamber comprising an intake shaft extending longitudinally through the intake chamber and coupled to an electric motor shaft and a multi-stage centrifugal pump shaft, the intake chamber further comprising a thrust bearing set comprising a stationary thrust bearing and a rotatable thrust runner, wherein a first face of the stationary thrust bearing positioned towards the rotatable thrust runner is at least partially diamond-coated, and wherein a second face of the rotatable thrust runner positioned towards the stationary thrust bearing is at least partially diamond-coated, a fluid entrance that receives the fluid into the intake chamber, and a pump inlet that receives the fluid into the multi-stage centrifugal pump, wherein the thrust bearing set is arranged about the intake shaft such that during operation of the electric motor the thrust bearing set is in a pathway of the fluid as the fluid flows between the fluid entrance and the pump inlet. In certain embodiments, the first face has a first plurality of diamond-coated pads, and the first plurality of diamond-coated pads are circumferentially dispersed about the first face, and wherein the second face has a second plurality of diamond-coated pads, and the second plurality of diamond-coated pads are circumferentially dispersed about the second face. In some embodiments, one of the rotatable thrust runner, the stationary thrust bearing, or a combination thereof comprises a first plurality of diamond-coated pads arranged in an inner circumferential row and a second plurality of diamond-coated pads arranged in an outer circumferential row, and wherein each of the first diamond-coated pads in the inner circumferential row is arranged interstitially between two of the second diamond-coated pads in the outer circumferential row. In certain embodiments, each diamond-coated pad of the first plurality of diamond-coated pads has a smaller diameter than each diamond-coated pad of the second plurality of diamond-coated pads. In some embodiments, the system further comprises a radial support sleeve keyed to the intake shaft between the thrust bearing set and the pump inlet.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

The above and other aspects, features and advantages of the invention will be more apparent from the following more particular description thereof, presented in conjunction with the following drawings wherein:

FIG. 16 is a side elevation view with part cutaway of an intake of an illustrative embodiment.

Figure 1:
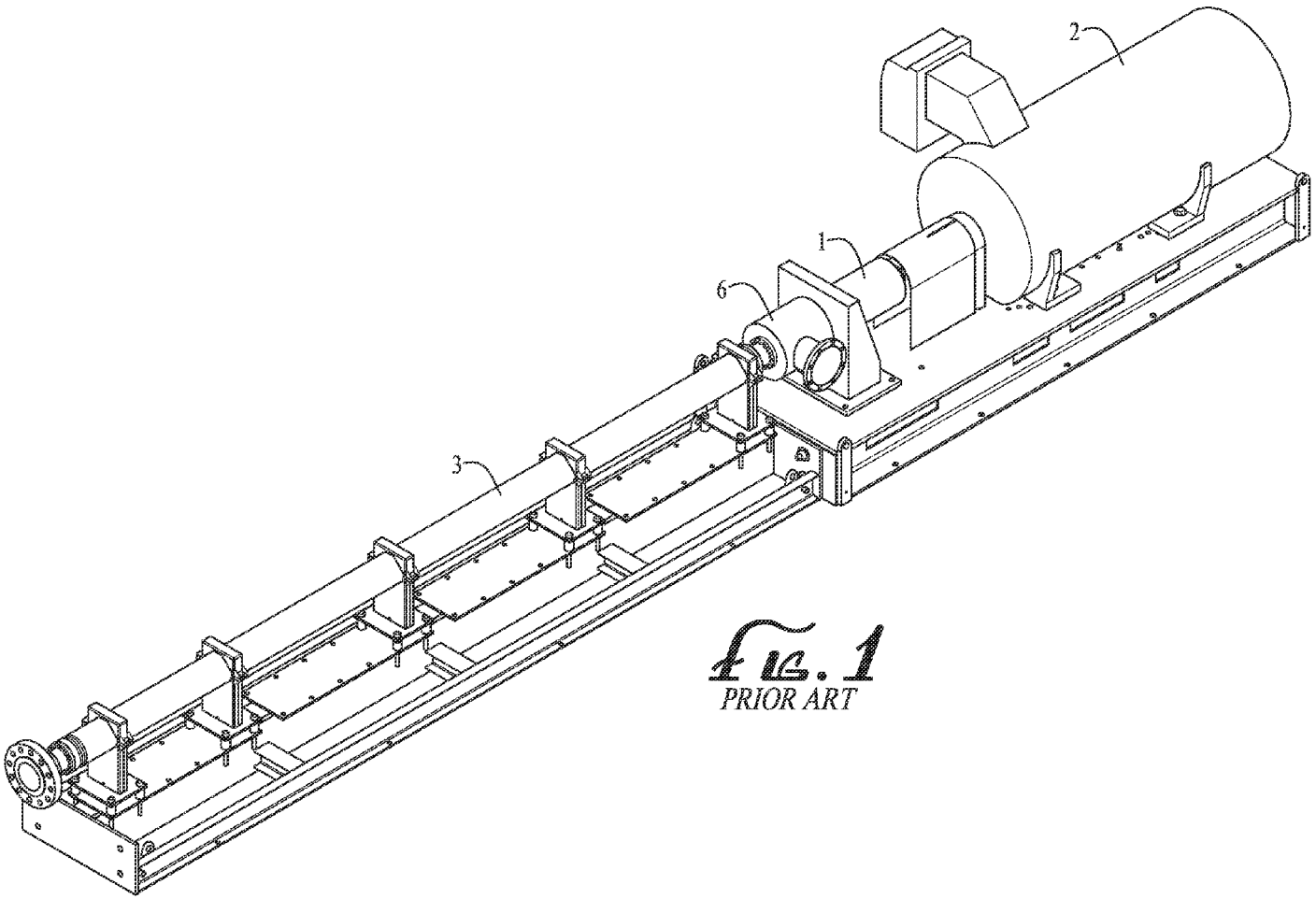
FIG. 1 PRIOR ART
FIG. 1 is a perspective view of a conventional horizontal surface pump assembly of the prior art.
Figure 2B:
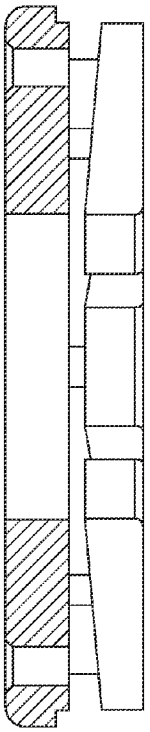
FIG. 2B PRIOR ART
FIG. 2B is a cross-sectional view across line 2B-2B of FIG. 2A of a conventional fixed disk of the prior art.
Figure 2A:
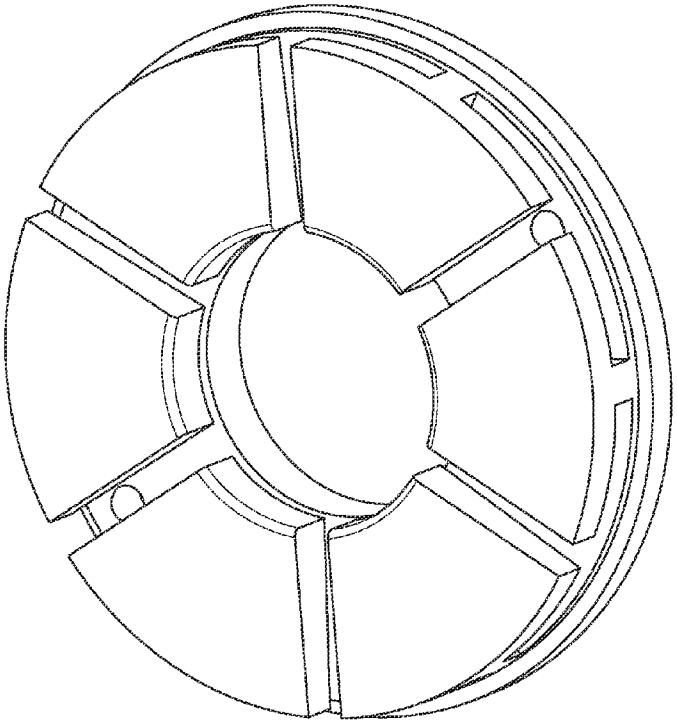
FIG. 2A PRIOR ART
FIG. 2A is a perspective view of a conventional fixed disk of the prior art.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

An apparatus and system for a thrust-absorbing horizontal surface pump assembly will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a diamond-coated pad includes one or more diamond-coated pads.

As used in this specification and the appended claims, the term "diamond" includes true diamond as well as other natural or manmade (synthetic) diamond-like carbon materials, which may have a crystalline and/or graphite structure. "Diamond coating" and "diamond-coated" as used herein is intended to encompass a pure diamond layer, such as a diamond table (of synthetic and/or natural diamond) as well as composites of diamond in combination with other materials and having at least 5% pure diamond by weight.

"Coupled" refers to either a direct connection or an indirect connection (e.g., at least one intervening connection) between one or more objects or components. The phrase "directly attached" means a direct connection between objects or components.

"Downstream" refers to the direction substantially with the principal flow of pumped fluid when the horizontal surface pump is in operation.

"Upstream" refers to the direction substantially opposite the principal flow of pumped fluid when the horizontal surface pump is in operation.

One or more embodiments of the invention provide an apparatus and system for a thrust-absorbing horizontal surface pump assembly. While for illustration purposes the invention is described in terms of an electric submersible pump employed in an above-ground, horizontal application, nothing herein is intended to limit the invention to that embodiment.

The invention disclosed herein includes an apparatus and system for a thrust-absorbing horizontal surface pump assembly. Illustrative embodiments include a thrust bearing assembly employed in the intake section of a horizontal surface pump assembly. Placing the thrust bearing assembly in the pump intake may entirely eliminate the need for a standalone thrust chamber, may eliminate the need to maintain a clean chamber of motor oil and/or may reduce the risk of damage to the thrust bearings from abrasives in pumped fluid. When the thrust bearing assembly is placed in the pump intake, pumped fluid making its way to the pump inlet flows around the bearing set, cooling the bearings and acting as a hydrodynamic fluid, rather than the motor oil and additives traditionally used as cooling fluid in conventional horizontal surface pump assemblies. Unique features of the thrust bearing set of illustrative embodiments may permit placement of the thrust bearing assembly in the intake.

A thrust bearing assembly of illustrative embodiments includes a thrust bearing and a thrust runner exposed to the pumped fluid. The thrust bearing and thrust runner each include diamond coated pads dispersed around a locking member. The diamond coated faces of the thrust bearing and the thrust runner allow initiation of the pump without the need for any lubrication or extreme pressure additives between the face of the thrust bearing and the face of the thrust runner. Once the pump is operating, a hydrodynamic film of pumped fluid may form between the thrust bearing and the thrust runner.

Illustrative embodiments of the invention utilize the strength of diamond to carry high axial loads from the pump in a limited surface area. A thrust bearing set of illustrative embodiments may carry about 5,000 pounds down force per square inch of surface area. In contrast, a conventional bronze pad bearing typically only handles about 500 pounds load per square inch of pad area. A thrust bearing of illustrative embodiments may be about four square inches in surface area. In some embodiments, the bearing set of illustrative embodiments is capable of carrying about ten times the load of conventional thrust bearings made from bronze and/or hardened steel, and operates successfully in situations where conventional bearings would fail due to mechanical overload. Illustrative embodiments may carry a shaft thrust load of 12,000 pounds, 15,000 pounds or 18,000 pounds and/or a flow of 25,000 or 30,000 bpd at 75%-80% efficiency, in one example.

Horizontal surface pump applications may require unique thrust handling capabilities as compared to downhole electric submersible pump (ESP) assemblies. In some embodiments, an electric submersible pump used in horizontal surface pump systems may include the same shaft diameter as its downhole counterpart but include housing of thicker diameter, and require increased thrust absorbing capabilities as compared to downhole ESP assemblies. By way of example but without limitation, a downhole ESP assembly may include a housing of a 4.0 inch diameter, whereas a horizontal surface pump may include a housing of 8.75 inches in diameter. In another example, 675 pumps may have an unmodified shaft but the housing may be increased from a 6.75 inch diameter to 7.25 inch diameter. In another embodiment, a downhole ESP assembly may include shafts of a 1.0 inch diameter, whereas a comparable horizontal surface pump may include shafts of 2.0-3.0 inches in diameter. In yet another embodiment, the housing and shaft diameters of the surface pump maybe unmodified between surface and downhole applications, but the surface ESP pump may include more stages in the surface application than the downhole application. In some instances a downhole ESP pump may be employed on the surface unmodified.

Illustrative embodiments of the invention may permit fluid with impurities, such as the working fluid, to form a hydrodynamic film between the diamond-coated thrust runner and diamond-coated thrust bearing of illustrative embodiments. In some embodiments, the hydrodynamic film is formed after a delay from the time that operation of the pump is initiated, without damage to the bearings. This feature of illustrative embodiments eliminates the need to use extreme pressure additives, locate and maintain the thrust runner and thrust bearing in a cavity of clean oil and/or standalone thrust chamber, and may assist in preventing the pump from being susceptible to loss of function from contaminants.

Use of diamond-coated bearings to carry shaft thrust loads in horizontal surface pump assemblies provides unexpected results. One of ordinary skill in the art would expect that the high temperatures reached within horizontal surface pump assemblies, which are has high as 150° F. or more, would cause the binders for the diamond coating of illustrative embodiments to flake away, resulting in the diamond coating to fall off of the bearings. However, contrary to expectations, pumped fluid moving about the system and apparatus of illustrative embodiments may provide sufficient heat removal from the bearings of illustrative embodiments to keep the diamond-coating intact without operation prohibitive flaking.

Because illustrative embodiments do not require a conventional thrust chamber, in the instance a bearing failure occurs, an assembled shaft and seal may be the only components that need replacement in the event of a bearing failure, rather than an entire thrust chamber as in conventional assemblies. In such instances, a back pull-out design may be employed to remove and replace the assembled intake shaft and seal. In addition, regular maintenance and motor oil changes necessary in conventional designs may not be necessary in illustrative embodiments.

Illustrative embodiments may operate without a hydrodynamic film prior to the film's formation, and at the same time suffer no damage to the bearings. Pumped fluid as the basis of a hydrodynamic film, carries about ten times the heat of a conventional motor oil-based hydrodynamic film (depending on the composition of the working fluid). Thus, illustrative embodiments of the invention may increase the lifespan of the bearing set, improve its strength and improve the heat handling capabilities.

Surface Pump Assembly

Figure 3:
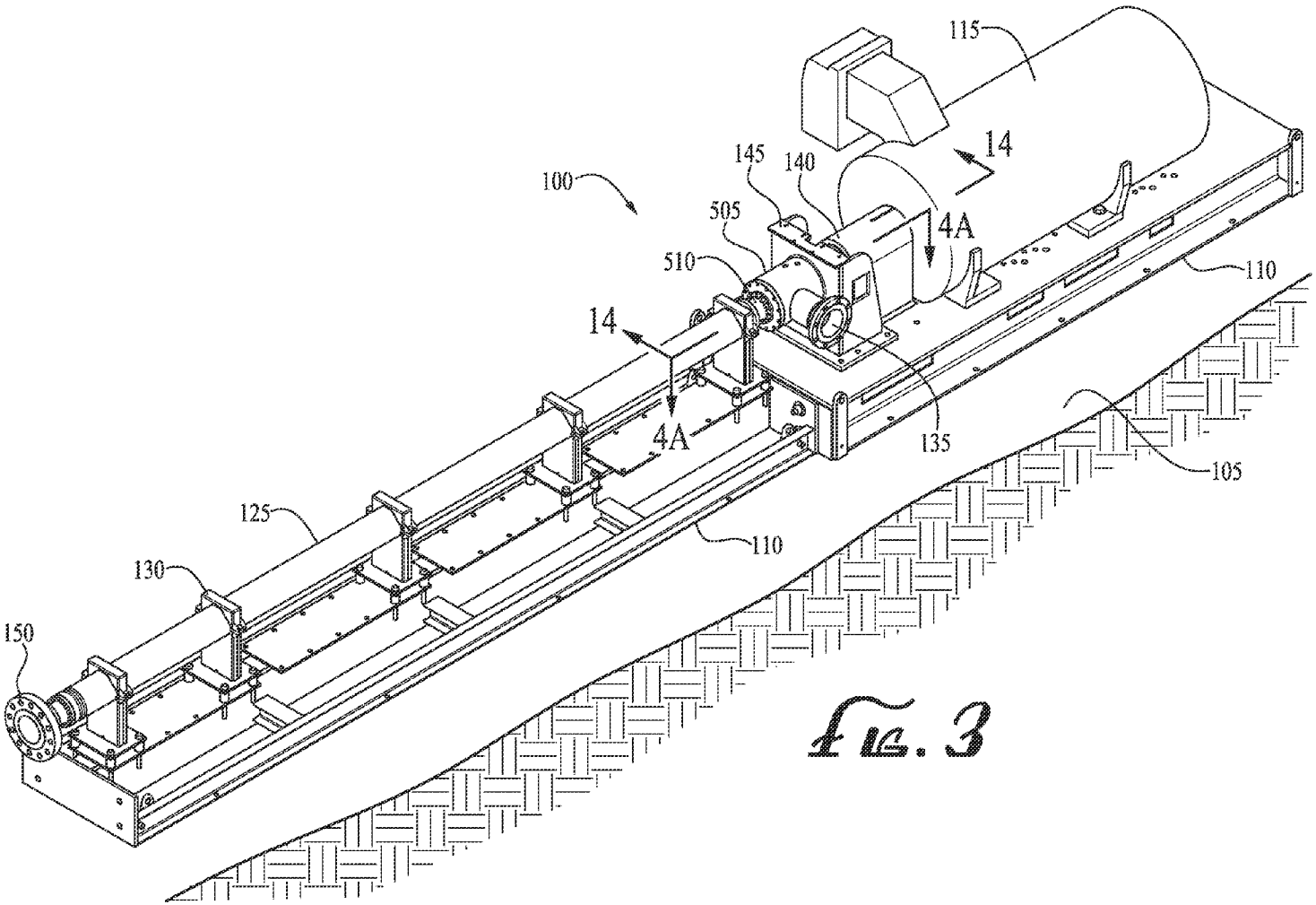
FIG. 3 is a perspective view of a horizontal surface pump assembly of an illustrative embodiment.

Illustrative embodiments include a horizontal surface pump assembly system. An exemplary horizontal pumping system is illustrated in FIG. 3. As shown in FIG. 3, horizontal surface pump assembly 100 is oriented substantially horizontally on surface 105, such that the length of assembly 100 is resting on, parallel and/or about parallel with surface 105. Pump assembly 100 may be mounted on one or more skids 110, such as a pump skid and/or a motor skid, and secured within saddles 130. Motor 115 may be a surface motor modified to operate with a submersible pump on surface 105 (rather than a submersible motor which operates with submersible pumps downhole) and/or an electric motor, and capable of causing rotation of the shafts that run through the center of the length of pump assembly 100. Motor 115 may be air-cooled and have minimal friction due to greased lube bearings or oil lube bearings. Other types of motors or prime movers having a horsepower range between about 75 and 3000 hp well known to those of skill in the art may be employed, and as such, are not described in further detail herein. In an example, a gas powered engine with a gear increaser could be used as motor 115.

Electric submersible pump 125 may be a multi-stage centrifugal pump conventionally used in downhole electric submersible pump (ESP) assemblies, but instead implemented here in a horizontal surface pump application. In some embodiments, the shaft and housing diameter of pump 125 may be the same when implemented on the surface as when implemented downhole. Exemplary ESP pump 125 shaft diameters may be ⅞ inch, 1.0 inch, 1 3/16 inch, 1.5 inch, or 1⅞ inch. In some embodiments, ESP pump 125 may be modified to include a shaft and/or housing of increased diameter as compared to a comparable downhole ESP pump. For example, the housing may be increased from a 4 inch diameter used in a downhole application to 8.75 inches for the surface pump application. In another example, a downhole ESP assembly may include shafts of a 1.0 inch diameter, whereas a horizontal surface pump may include shafts of 2.0-3.0 inches in diameter. ESP pump 125 may also be capable of functioning in downhole and/or submersible environments.

Intake chamber 505 may extend between motor 115 and pump 125, connected to motor 115 by way of a flex or disc coupling, and serving as the intake for ESP pump 125. In some embodiments, intake shaft 200 may be directly attached to a drop out spacer coupling, which is directly attached to the motor 115. In some embodiments, Intake chamber 505 may also include bearings for carrying thrust and providing radial support, serving in a dual intake and thrust capacity. Horizontal surface pump assembly 100 does not include a standalone thrust chamber, but rather, intake chamber 505 serves as a combined thrust and intake chamber. Motor coupling cover 140 may secure motor 115 and intake chamber 505 together, whilst intake chamber bracket 145 may support intake chamber 505 and assist in holding intake chamber 505 in place.

Pumped fluid may enter assembly 100 through fluid entrance 135 of intake chamber 505. Fluid entrance 135 may be connected to hoses, piping, a container, and/or a fluid source. Once fluid proceeds through fluid entrance 135 and enters intake chamber 505, it may then proceed to pump inlet 510. In the process of passing from fluid entrance 135 to pump inlet 510, the working fluid may flow around, about and/or through thrust bearings of illustrative embodiments. From pump inlet 510, fluid may continue through ESP pump 125 to pump discharge 150, after which the fluid is transported to its destination. A portion of fluid from discharge 150 may be routed back into intake chamber 505 as part of a mechanical seal flush. Fluid exiting the flush may also be employed to cool and/or lubricate radial support and/or thrust bearings in intake section 505 of illustrative embodiments. Pumped fluid may be oil, injection water, fluid hydrocarbons, bromine, liquefied chicken fat, or any other liquid desired to be carried from one surface location to another and/or between the surface and a downhole location, and that adequately cools and lubricates the bearings of illustrative embodiments.

Embodiments of pump assembly 100 described herein are uniquely suited to handle the extreme axial load requirements and ambient conditions experienced by horizontal surface assemblies and the applicable benefits obtained from illustrative embodiments of the invention.

Intake Section

Figure 4A:
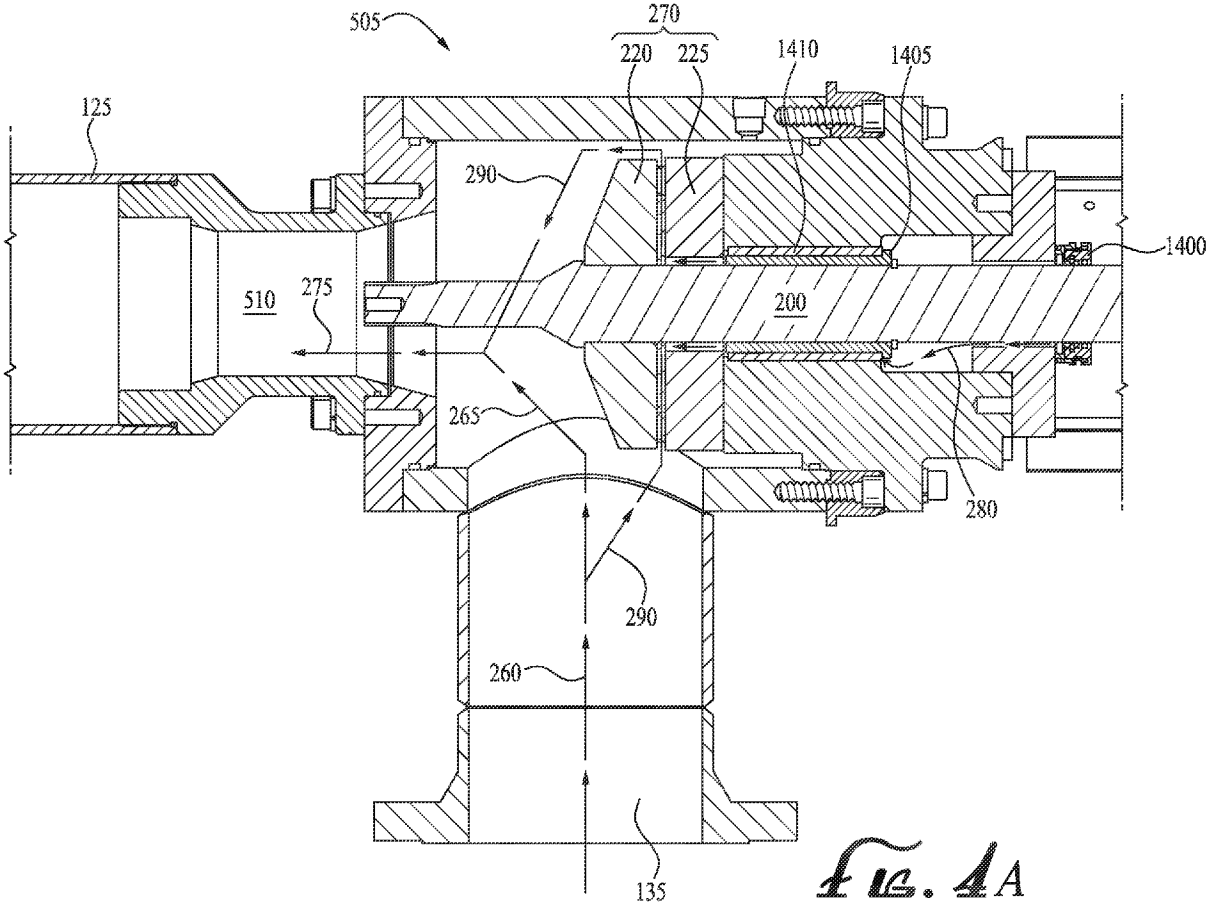
FIG. 4A is a cross sectional view across line 4A-4A of FIG. 3 of a horizontal surface pump intake of an illustrative embodiment illustrating an exemplary flow of pumped fluid.
Figure 4B:
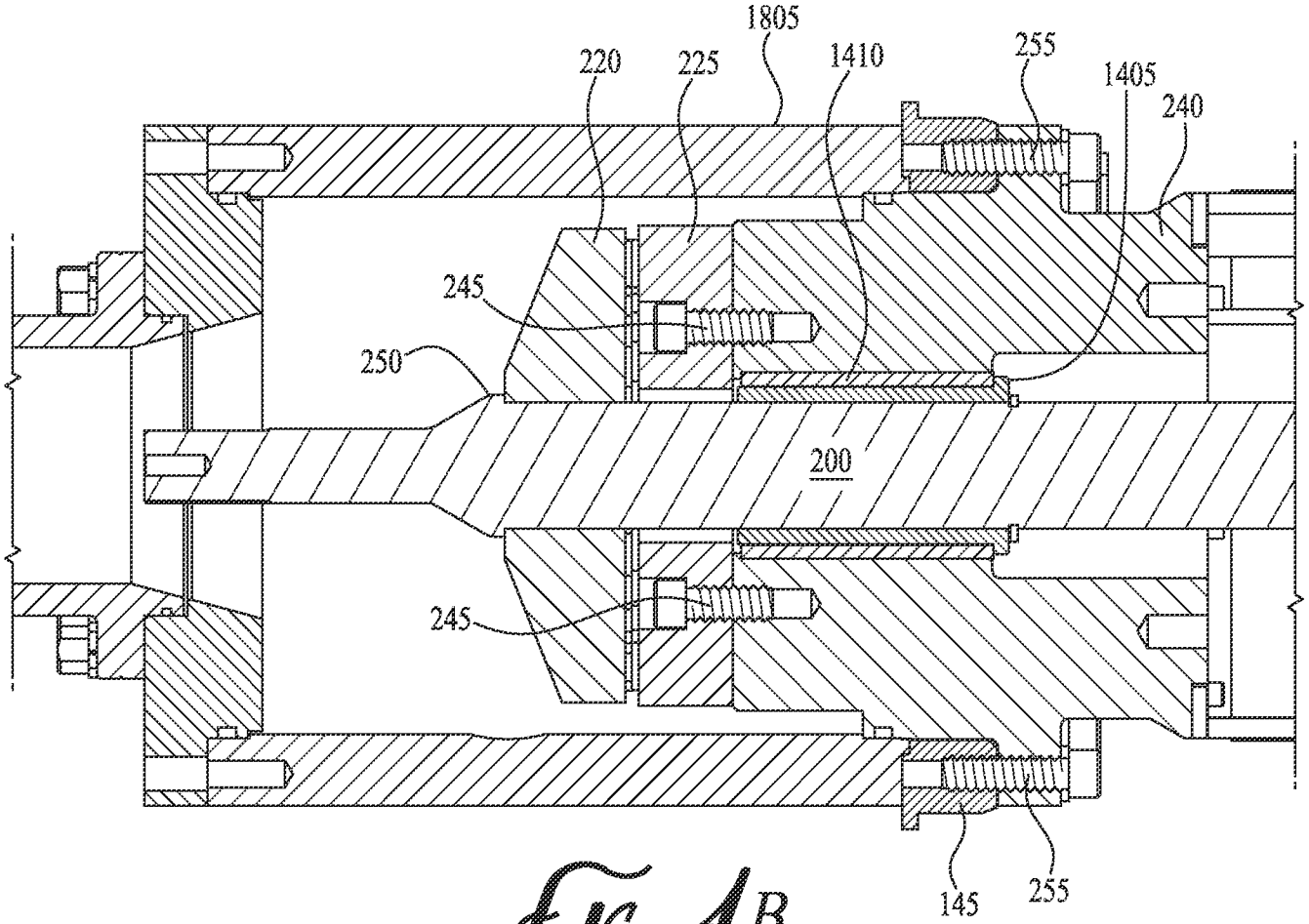
FIG. 4B is a cross sectional view of a horizontal surface pump intake of an illustrative embodiment.
Figure 4C:
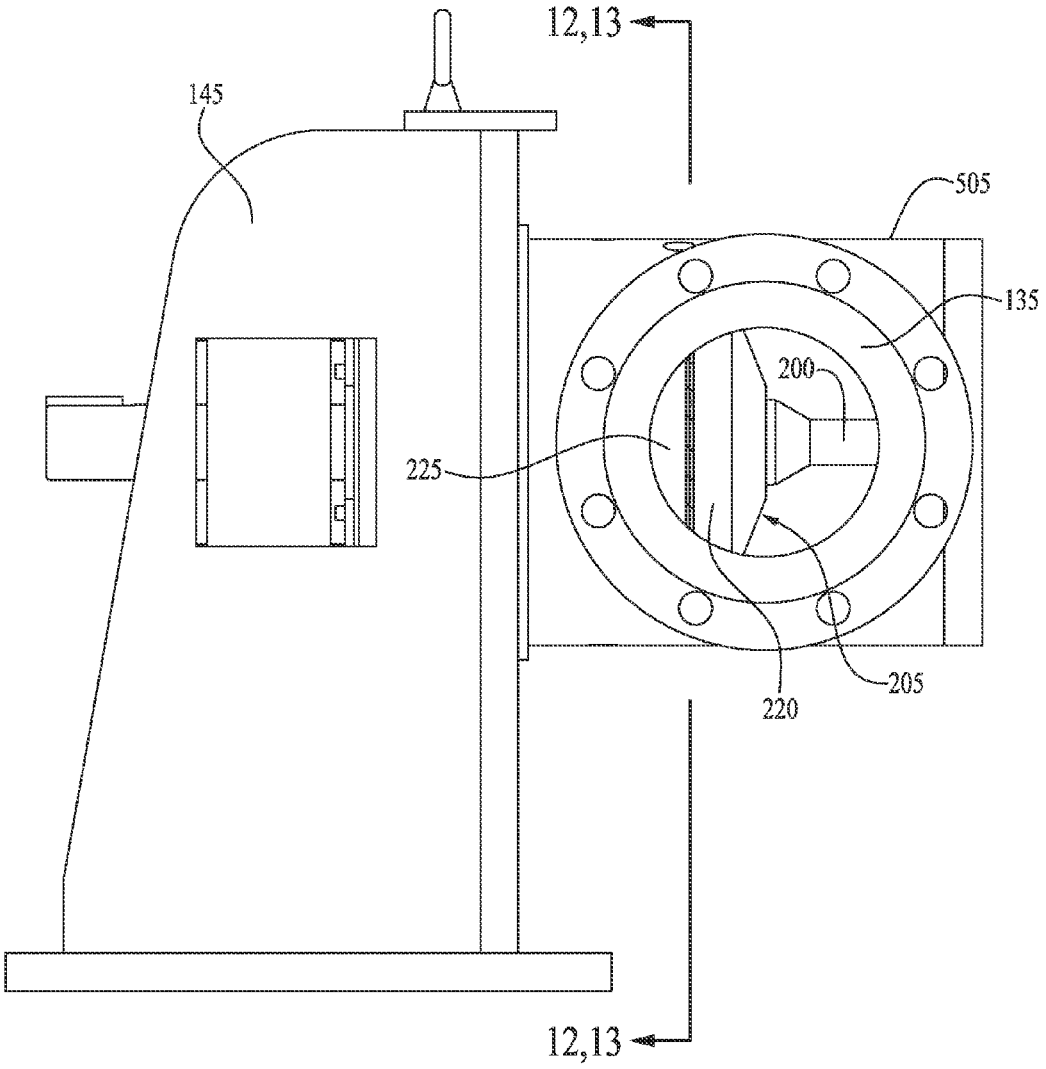
FIG. 4C is a side elevation view of a horizontal surface pump intake of an illustrative embodiment.

FIGS. 4A-4C illustrate an intake section of a horizontal surface pump assembly of illustrative embodiments. As shown in FIG. 4A, stationary thrust bearing 225 and rotatable thrust runner 220 are located in intake chamber 505, in the pathway of pumped fluid during operation of ESP pump 125. In some embodiments, only a single thrust bearing 225 and single thrust runner 220 may be employed. Shaft 200 is positioned through the center of intake 505 and may be connected to the shaft of surface motor 115 (shown in FIG. 3) such that shaft 200 is rotated by surface motor 115. Pumped fluid may enter intake section 505 at fluid entrance 135, be drawn into ESP pump 125 at pump inlet 510, and be moved and/or lifted by pump 125 towards its destination.

As illustrated in FIG. 4B, thrust runner 220 may be keyed to intake shaft 200, or otherwise coupled (e.g., by friction) to shaft 200, such that thrust runner 220 rotates with shaft 200 during operation of ESP pump 125. Shaft shoulder 250 may prevent axial movement of thrust runner 220. In the example shown in FIG. 4B, shaft shoulder 250 may prevent axial movement of thrust runner 220 towards pump inlet 510, despite suction of the pump in that direction. Thrust bearing 225 may be secured to chamber base 240 of intake 505 with socket head bolts 245 and remain stationary during rotation of shaft 200. Chamber base 240 may be secured to intake chamber bracket 145 with chamber bolts 255.

Locating thrust runner 220 and thrust bearing 225 in intake chamber 505 may improve the thrust handling capability of thrust runner 200 and thrust bearing 225 and reduce buckling, as compared to locating thrust runner 220 and thrust bearing 225 in a cavity of clean motor oil in a thrust chamber or seal chamber. Conventional thrust bearings are ill-equipped for location outside the conventional motor-oil cavity due to the necessity of maintaining conventional thrust bearings within clean motor oil and/or extreme pressure additives. Illustrative embodiments are not so limited.

Intake Section Fluid Flow

Returning to FIG. 4A, pumped fluid 260 enters intake 505 through fluid entrance 135, and proceeds into assembly intake chamber 505. A first portion 265 of the pumped fluid may proceed directly into ESP pump 125. A second portion 290 of pumped fluid flows around, about and/or through bearing faces 1035, 425 (shown in FIGS. 10A and 11A), lubricating and cooling the bearing set 270. After passing through the bearing set 270, the second portion 290 of pumped fluid may join the first portion 265 of pumped fluid entering ESP pump 125.

As the discharge-bound fluid 275 proceeds through ESP pump 125 and exits assembly 100 through discharge 150, a small bypass may be plumbed back to mechanical seal 1400. The fluid exiting the pump 125 is at a higher pressure than the fluid entering the pump 125, and this pressure differential keeps a portion of the discharge-bound fluid 275, illustrated in FIG. 4A as bypass fluid 280, flowing through the bypass and into mechanical seal 1400. Bypass fluid 280 (flush) cools and lubricates mechanical seal 1400. After passing by mechanical seal 1400, bypass fluid 280 may also cool and lubricate radial bearings, sleeve 1405 and bushing 1410. Bypass fluid 280 may then combine with the second portion 290 of pumped fluid to cool and lubricate the thrust bearing set 270 before re-entering the ESP pump 125. Bypass fluid 280 may be directed from discharge 150 to mechanical seal 1400 using a flush plan well known to those of skill in the art, for example American Petroleum Institute's Flush Plan 11. Mechanical seal 1400 may be a shaft seal, type 2 seal, or cartridge seal.

FIGS. 4A, 4C and 16 illustrate positioning of thrust bearing 225 and thrust runner 220 within intake section 505. As shown, thrust runner 220 and thrust bearing 225 may be placed upstream from the direct path of first portion 265 of pumped fluid making its way to pump inlet 510 and still come into contact with sufficient fluid (second portion 290) to benefit from the lubricating and cooling benefits of the fluid. Bearing 270 may be positioned such that it is tangentially in the flow path (i.e., not directly in the path of first portion 265 of pumped fluid). The location of bearing set 270 may be calculated to ensure the bearings are cooled adequately without choking the flow of pump 125.

Thrust Bearings

Figure 10B:
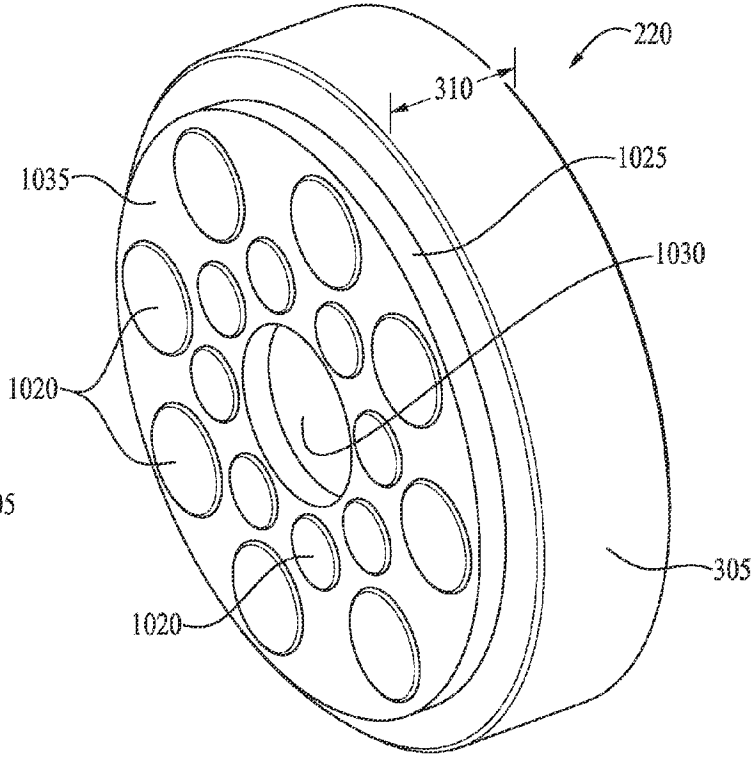
FIG. 10B is a perspective view of a thrust runner of an illustrative embodiment.
Figure 10A:
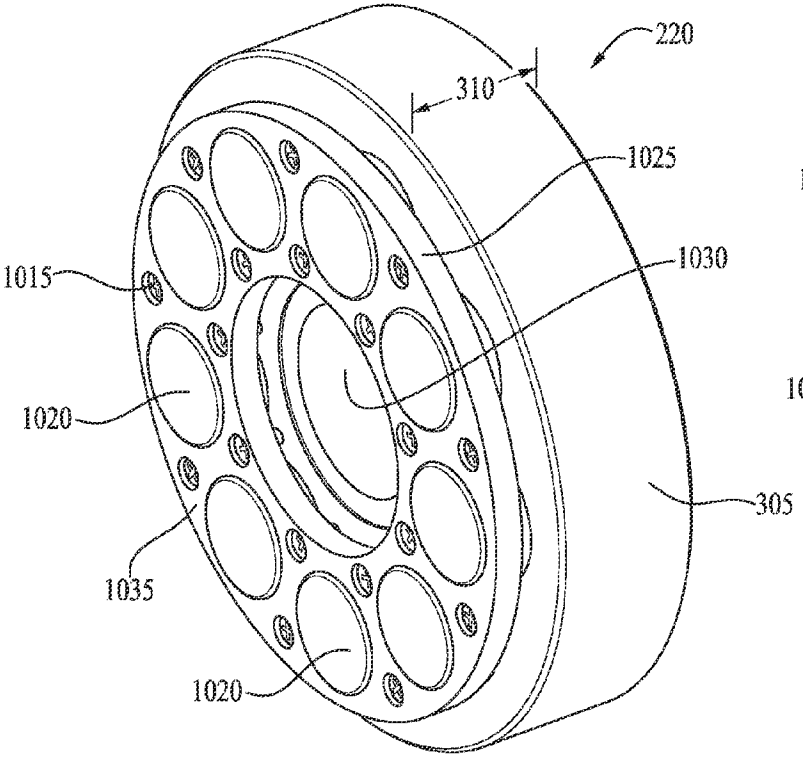
FIG. 10A is a perspective view of a thrust runner of an illustrative embodiment.

FIGS. 10A and 10B illustrate exemplary thrust runners of illustrative embodiments. As shown in FIGS. 10A and 10B, thrust runner 220 includes runner base 305, which may be keyed to intake shaft 200 (shown in FIG. 4B). Runner locking plate 1025 may be secured to runner base 305. As illustrated in FIG. 10A, runner locking plate 1025 may be secured to runner base 305 with a series of bearing screws 1015 and/or with fasteners. In some embodiments, as illustrated in 10B, runner locking plate 1025 may be brazed in place. Runner locking plate 1025 may be raised with respect to runner base 305, as illustrated in FIG. 10A. In another example, locking plate 1025 may rest on runner base 305, as illustrated in FIG. 10B. Thickness 310 of runner base 305 may be of sufficient thickness to increase the load handling capability of the flat diamond surfaces of illustrative embodiments such that runner base 305, runner pad 1020 or runner locking plate 1025 will not bend, deflect or yield under load. Bearing screws 1015 and/or silver brazing may additionally secure runner pads 1020 into place or may secure runner pads 1020 in place rather than runner locking plate 1025. In one example, runner pads 1020 may be screwed to runner base 305 with screws 1015, and runner pads 1020 may be secured in place by runner locking plate 1025.

A plurality of runner pads 1020, which runner pads 1020 may be diamond-coated, may be arranged circumferentially about runner locking plate 1025 and/or runner base 305, for example as illustrated in FIGS. 10A and 10B. As shown in FIG. 10A, nine, uniformly sized runner pads 1020 are arranged about runner face 1035. As shown in FIG. 10B, runner pads 1020 may be arranged in multiple circumferential rows around runner locking plate 1025 and/or runner base 305. In the exemplary embodiment of FIG. 10B, eight runner pads 1020 on the inner circumference may have a smaller diameter than eight runner pads 1020 on the outer circumference, and the runner pads 1020 on the inner circumference may be arranged interstitially between runner pads 1020 on an outer circumference. The embodiment shown in 10B may allow runner pads to be positioned closer to the center of runner locking plate 1025 and/or runner face 1035, thereby providing a higher unit load. The embodiment of FIG. 10B may also maximize diamond-coated runner pad 1020 density and reduce heat. The surface velocity of the inner circumferential row of runner pads 1020 may be lower, reducing heat buildup and wear relative to the outer circumferential row of runner pads 1020. In other embodiments, runner pads 1020 may be randomly dispersed about locking plate 1025, runner base 305 and/or runner face 1035.

In some embodiments, runner pad 1020 may be a single diamond-coated disc. In certain embodiments, at least three runner pads 1020 may be arranged about runner locking plate 1025. The size and number of runner pads 1020 may depend upon the required loads and size of the surface area of runner face 1035 and/or runner locking plate 1025. In some embodiments, runner pads 1020 include a circular surface area and are distributed uniformly around runner opening 1030 of base 305, through which shaft 200 may run. Runner pads 1020 may be circular in surface area and be 9 mm, 16 mm, ½ inch, ⅝ inch, and/or ¾ inch in diameter. Other sizes of runner pads 1020 may be used based on required loads, the outer diameter of thrust runner 220, and/or shape of runner pad 1020, which in some embodiments may not be circular in profile. In some embodiments runner pads 1020 may be made with different profiles other than round, for example a sector of a circle, a modified ellipse, pie shape or a parallelogram. The number of runner pads 1020 may vary depending on the diameter of the overall bearing, the shape and size of runner pads 1020 and/or required loads.

Figure 11B:
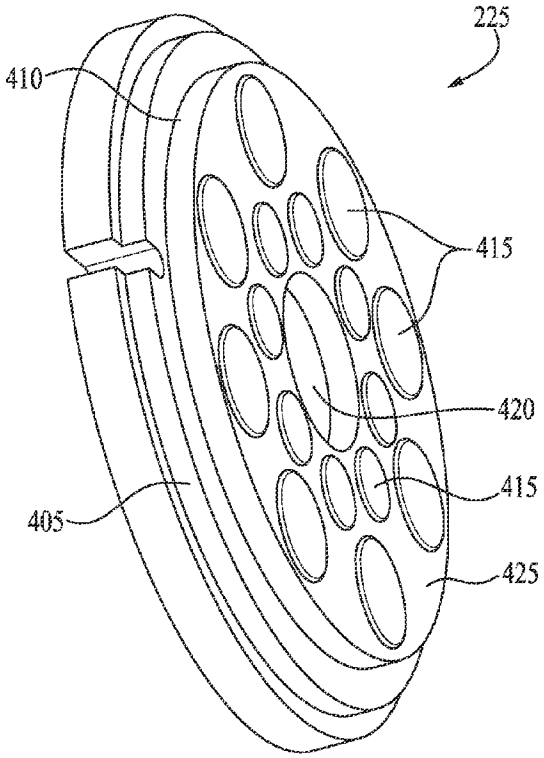
FIG. 11B is a perspective view of a thrust bearing of an illustrative embodiment.
Figure 11A:
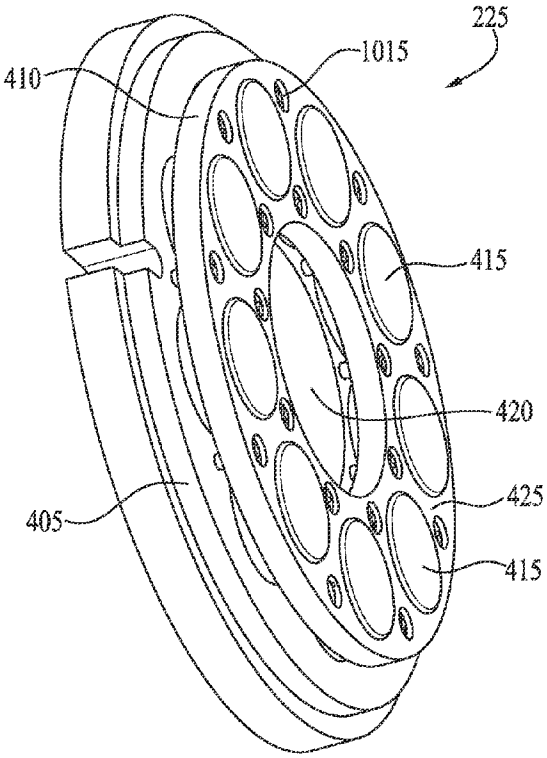
FIG. 11A is a perspective view of a thrust bearing of an illustrative embodiment.

Illustrative embodiments of thrust bearing 225 are shown in FIGS. 11A and 11B. Thrust bearing 225 may remain stationary during operation of the pump assembly. Thrust bearing 225 may be mounted to chamber base 240 (shown in FIG. 4B) of intake 505 with socket head bolts 245. Thrust bearing 225 may include bearing holder 405, to which bearing locking plate 410 may be secured. Bearing locking plate 410 may be raised with respect to bearing holder 405, as illustrated in FIG. 11A. In another example, bearing locking plate 410 may rest on bearing holder 405, as illustrated in FIG. 11B. As illustrated in FIG. 11A, bearing locking plate 410 may be secured to bearing holder 405 with a series of bearing screws 1015 and/or with fasteners. In some embodiments, as illustrated in 11B, bearing locking plate 410 may be brazed in place. Bearing screws 1015, fasteners and/or silver brazing may additionally secure bearing pads 415 into place, or may secure bearing pads 415 in place rather than bearing locking plate 410. In one example, bearing pads 415 may be screwed to bearing holder 405 with screws 1015, and bearing pads 415 may be secured in place by bearing locking plate 410.

A plurality of bearing pads 415, which may be diamond-coated, may be arranged circumferentially about bearing locking plate 410 and/or bearing holder 405, for example as illustrated in FIGS. 11A and 11B. As shown in FIG. 11A, nine, uniformly sized bearing pads 415 are arranged about bearing face 425. As shown in FIG. 11B, bearing pads 415 may be arranged in multiple circumferential rows around bearing locking plate 410 and/or bearing holder 405. In the exemplary embodiment of FIG. 11B, eight bearing pads 415 on the inner circumferential row may have a smaller diameter than eight bearing pads 415 on the outer circumferential row, and the bearing pads 415 on the inner circumference may be arranged interstitially between bearing pads 415 on an outer circumference. The embodiment shown in 11B may allow bearing pads 415 to be positioned closer to the center of locking plate 410, thereby providing a higher unit load. The embodiment of FIG. 11B may also maximize diamond-coated bearing pad 415 density and reduce heat. The surface velocity of the inner circumferential row of bearing pads 415 may be lower, reducing heat buildup and wear relative to the outer circumferential row of bearing pads 415.

In some embodiments, bearing pads 415 may be randomly dispersed about bearing locking plate 410. In other embodiments, bearing pad 415 may be a single diamond-coated disc. In certain embodiments, at least three bearing pads 415 may be arranged about bearing locking plate 410. The size and number of bearing pads 415 may depend upon the required loads, size and/or cross-sectional area of bearing face 425 and/or bearing locking plate 410. In some embodiments, bearing pads 415 include a circular surface area and are distributed uniformly around bearing opening 420 of bearing holder 405. Bearing pads 415 may be circular in surface area and be 9 mm, 16 mm, ½ inch, ⅝ inch, and/or ¾ inch in diameter. Other sizes of bearing pads 415 may be used, depending on required loads, the outer diameter of thrust bearing 225, and the shape of bearing pad 415. In some embodiments bearing pad 415 may be made with different profiles other than round, for example a sector of a circle, a parallelogram, a pie shape or a modified ellipse. The number of bearing pads 415 may vary depending on the loads, diameter and/or circumference of the overall bearing.

The arrangement of bearings pads 415 about bearing locking plate 410 may or may not mirror the arrangement of runner pads 1020 about runner locking plate 1025. Pad arrangements may be selected such that, at any point in the rotation of thrust runner 220 with respect to thrust bearing 225, at least one bearing pad 415 is always opposite at least a portion of at least one runner pad 1020.

Figure 5A:
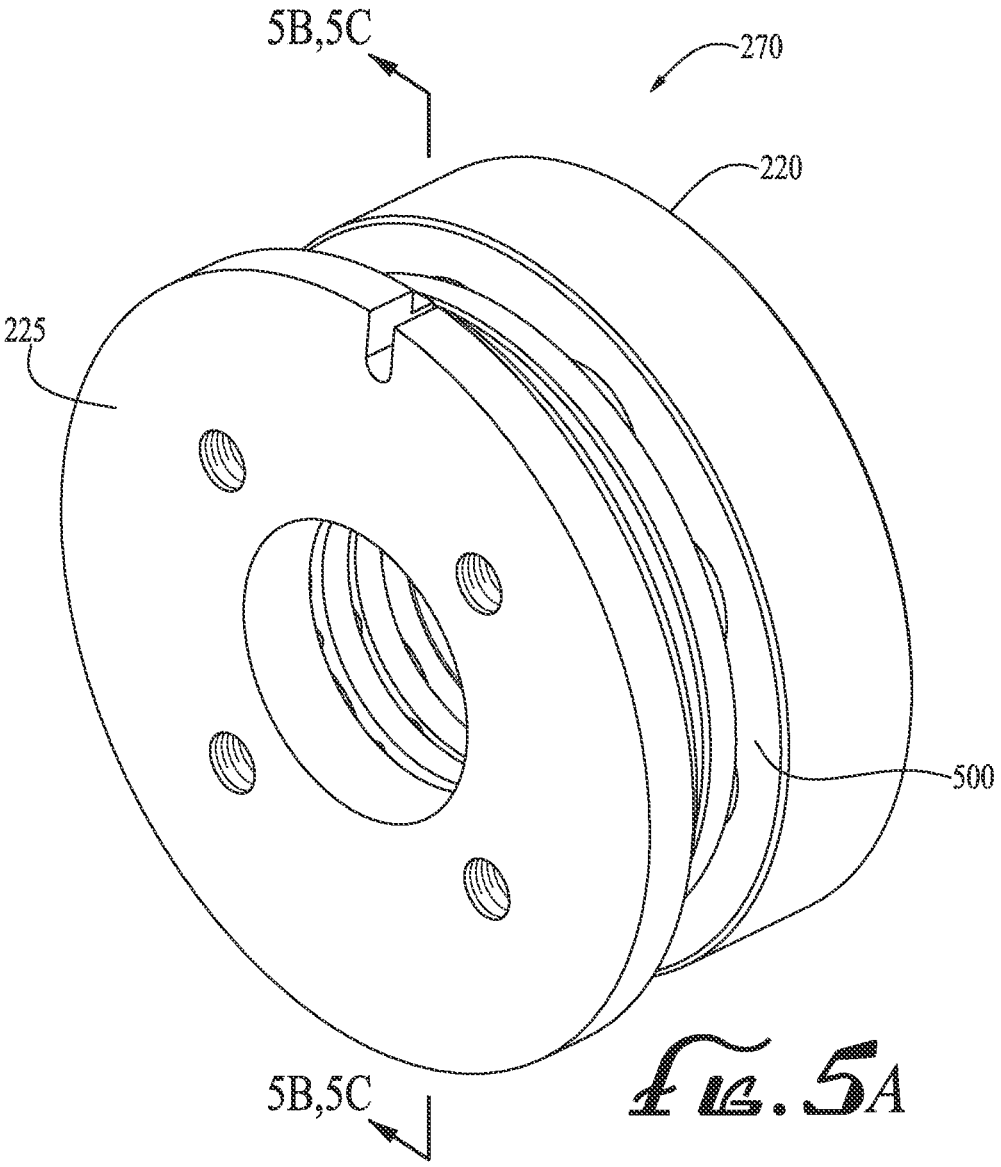
FIG. 5A is a perspective view of a thrust bearing set of an illustrative embodiment.
Figure 5C:
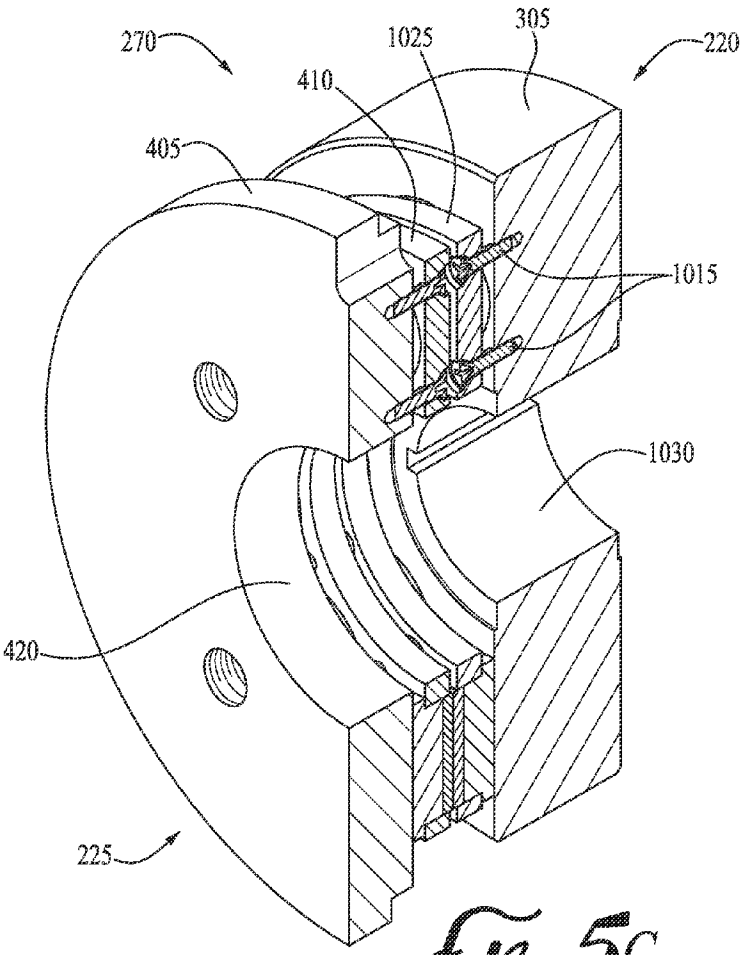
FIG. 5C is a cross sectional view across line 5C-5C of FIG. 5A of a thrust bearing set of an illustrative embodiment.
Figure 5B:
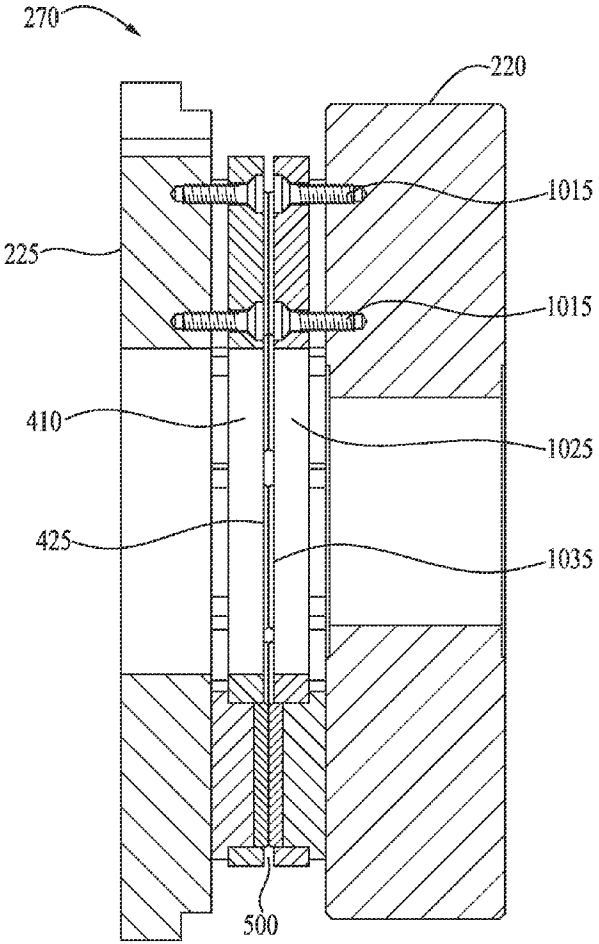
FIG. 5B is a cross sectional view across line 5B-5B of FIG. 5A of a thrust bearing set of an illustrative embodiment.

FIGS. 5A, 5B and 5C are illustrative embodiments of thrust runner 220 paired with thrust bearing 225 to form bearing set 270. Faces 1035, 425 face towards each other, with space 500 in between them, space 500 sufficient to accommodate a hydrodynamic film. Space 500 may be between about 0.00001 to 0.005 inches separation due to temperature and fluid viscosity. Water and oil are considered incompressible fluids. As the velocity of thrust runner 220 increases, a fluid wedge may be created in space 500, which separates faces 1035, 425 from one another. The wedge may increase in height with the speed of rotating shaft 220 and thrust runner 220, providing greater load capacity. However, unlike conventional bearings, the diamond-coated faces 1035, 435 of illustrative embodiments can operate against each other without a hydrodynamic profile. Unlike conventional bearings, pumped fluid, rather than motor-oil, is used to remove heat. Thus, bearing pads 415 operating on runner pads 1020 of illustrative embodiments may allow more surface area to be exposed for better heat transfer. A hydrodynamic wedge may occur in illustrative embodiments, but unlike conventional designs, the hydrodynamic wedge is not necessary for performance of bearing set 270. Thus, these illustrative embodiments reduce heat and friction in order to increase load capacity. In illustrative embodiments, the movement of fluid between faces 1035, 425 may sufficiently cool bearing set 270 such that the diamond coating on bearing pads 415 and runner pads 1020 remains intact and may not flake away.

Figure 6:
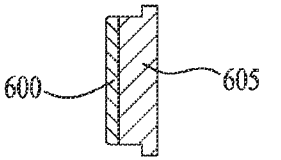
FIG. 6 is a sectional view of a diamond-coated pad of an illustrative embodiment.

FIG. 6 is an illustration of an exemplary diamond-coated pad of illustrative embodiments. Bearing pad 415 is illustrated in FIG. 6, but runner pad 1020 may similarly be as illustrated. Bearing and/or runner pad(s) 415, 1020 may be diamond coated, include a diamond layer, made of diamond, include leached diamond and/or comprise diamond, for example diamond coating 600. In some embodiments, bearing and runner pads 415, 1020 may be a polycrystalline diamond cutter (PDC), such as a micron-sized synthetic diamond powder bonded together by sintering at high pressures and temperatures and/or a polycrystalline diamond top layer integrally sintered onto a tungsten carbide substrate using a high-pressure, high-temperature process. US Synthetic of Orem, Utah, Element Six of Luxembourg, Logan Superabrasives of Houston, Tex., Fujian Wanlong Diamond Tool Co., Ltd. of Fujian, and China Zhengzhou LD Diamond Products Co., Ltd. of Zhengzhou, China supply suitable polycrystalline diamond cutters that may be employed in illustrative embodiments. In some embodiments, bearing and runner pads 415, 1020 may comprise a polycrystalline matrix of inter-bonded, hard carbon-based crystals. For example, bearing and/or runner pads 415, 1020 may comprise a facing table of polycrystalline diamond integrally bonded to a substrate of less hard material, such as tungsten carbide and/or pad base 605, which pad base may be tungsten carbide. In embodiments including leached diamond, the leached diamond may include a polycrystalline matrix whereby the cobalt or other binder-catalyzing material in the polycrystalline diamond is leached out from the continuous interstitial matrix after formation.

Illustrative embodiments may include a method of aligning the heights of pads 1020, 415. The height of each runner pad 1020 may be aligned with each of the other runner pads 1020 within several thousandths of an inch (e.g., within 0.001, 0.002 or 0.004 inches), such that each runner pad 1020 is close to or on the same horizontal plane. The surface of each runner pad may be lapped to finish the surface of diamond coating 600. Similarly, each bearing pad 415 may be aligned within a few thousandths of an inch and lapped to finish. Diamond coating 600 (e.g., a diamond table) on a PDC may be tens of thousandths (e.g., fifty, sixty or eighty thousandths) of an inch thick and aligned within a few thousandths, such that a couple thousands may be lapped and still have plenty of table remaining on diamond coating 600. In some embodiments, pads 1020, 415 may be brazed in place with no alignment within a few thousandths by machining a slot to receive the cutter in a fashion similar to that used on bits, and then diamond coating 600 may be subsequently lapped if needed to align the upper surface of the pads 1020, 415.

As shown in FIGS. 7A, 10A, 10B, 11A and 11B, bearing pad 415 and/or runner pad 1020 may have a circular cross-sectional area, or may have an elliptical, circular, quadrangular, pie-shaped or sector profile. Pad base 605 may be made of tungsten carbide and comprises diamond coating 600. In certain embodiments, the diamond coating may be between about 0.070 and 0.080 inches thick, or may be between a few thousandths of an inch thick and 0.5 inch thick or more. In some embodiments, diamond coating 600 may be a diamond wafer that is silver brazed to pad base 605 or diamond coating 600 may be a diamond table.

Figure 7B:
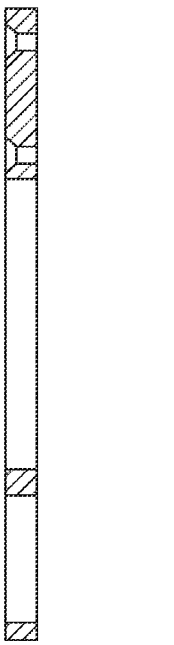
FIG. 7B is a cross sectional view across line 7B-7B of FIG. 7A of a locking plate of an illustrative embodiment.
Figure 7A:
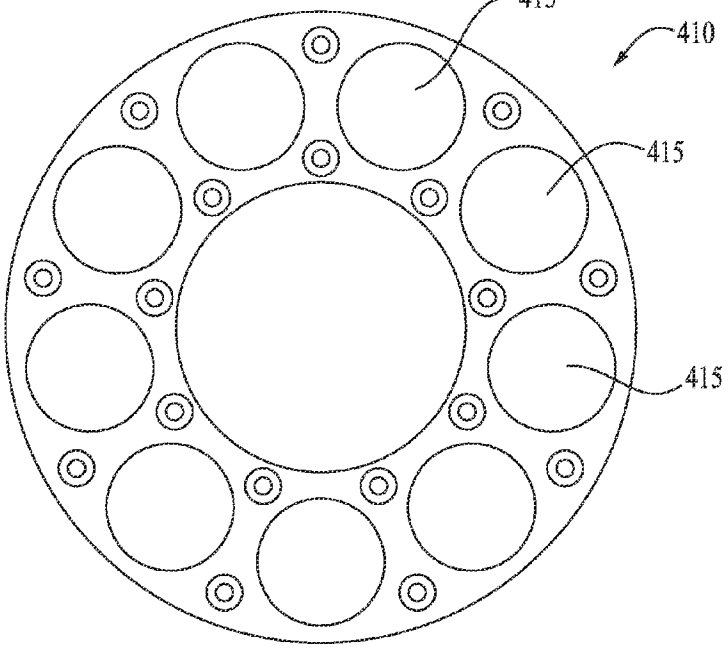
FIG. 7A is a plan view of a locking plate of an illustrative embodiment.
Figure 8B:
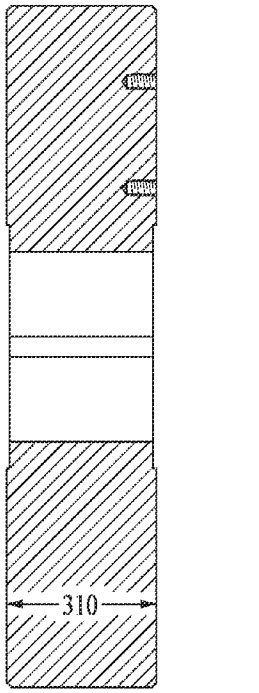
FIG. 8B is a cross-sectional view across line 8B-8B of FIG. 8A of a runner base of an illustrative embodiment.
Figure 8A:
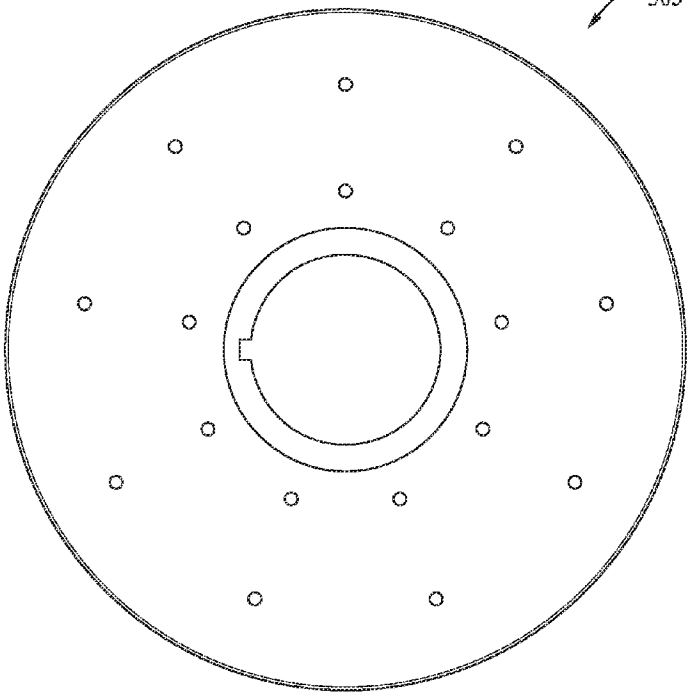
FIG. 8A is a plan view of a runner base of an illustrative embodiment.
Figure 9B:
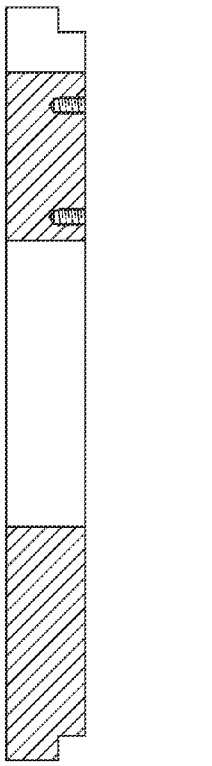
FIG. 9B is a cross sectional view across line 9B-9B of FIG. 9A of a bearing holder of an illustrative embodiment.
Figure 9A:
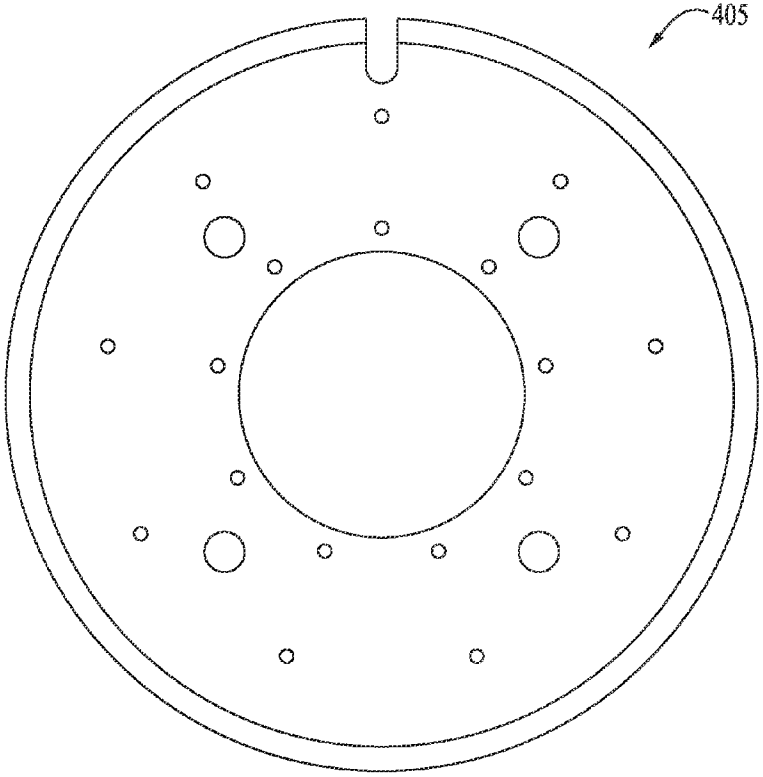
FIG. 9A is a plan view of an illustrative embodiment of a bearing holder.

FIGS. 7A and 7B illustrate an exemplary embodiment of a locking member. Bearing locking plate 410 is illustrated in FIGS. 7A and 7B, but runner locking plate 1025 may also be as illustrated. As shown in FIG. 7A, nine bearing pads 415 are evenly and circumferentially placed about openings in locking plate 410. FIGS. 8A and 8B are an illustrative embodiment of runner base 305 of thrust runner 220. FIGS. 9A and 9B are an illustrative embodiment of bearing holder 405. As demonstrated in FIGS. 8B and 9B, runner base 305 may have an increased thickness 310 as compared to the thickness of bearing holder 405.

Figure 12:
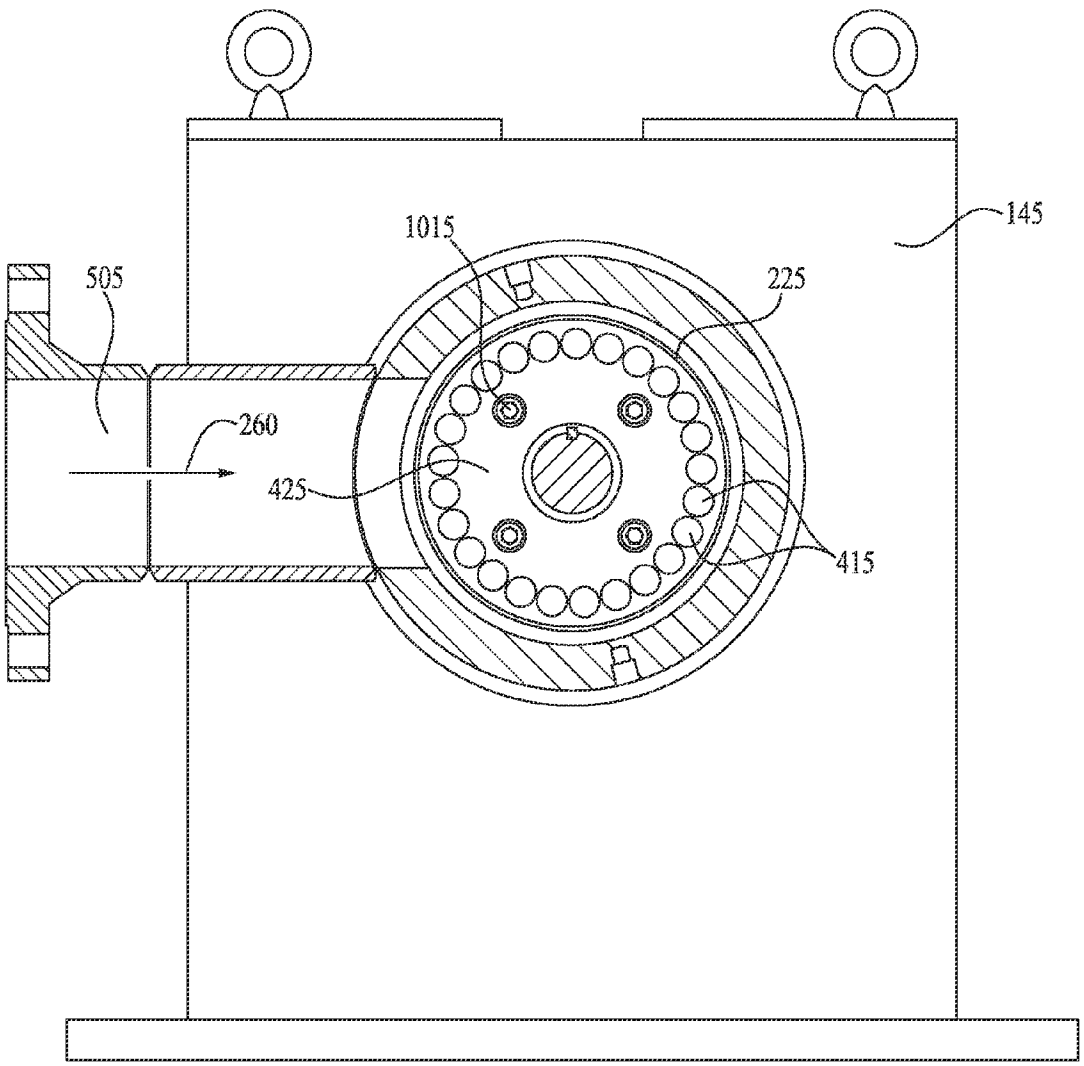
FIG. 12 is a cross sectional view across line 12-12 of FIG. 4C of an intake of an illustrative embodiment.
Figure 13:
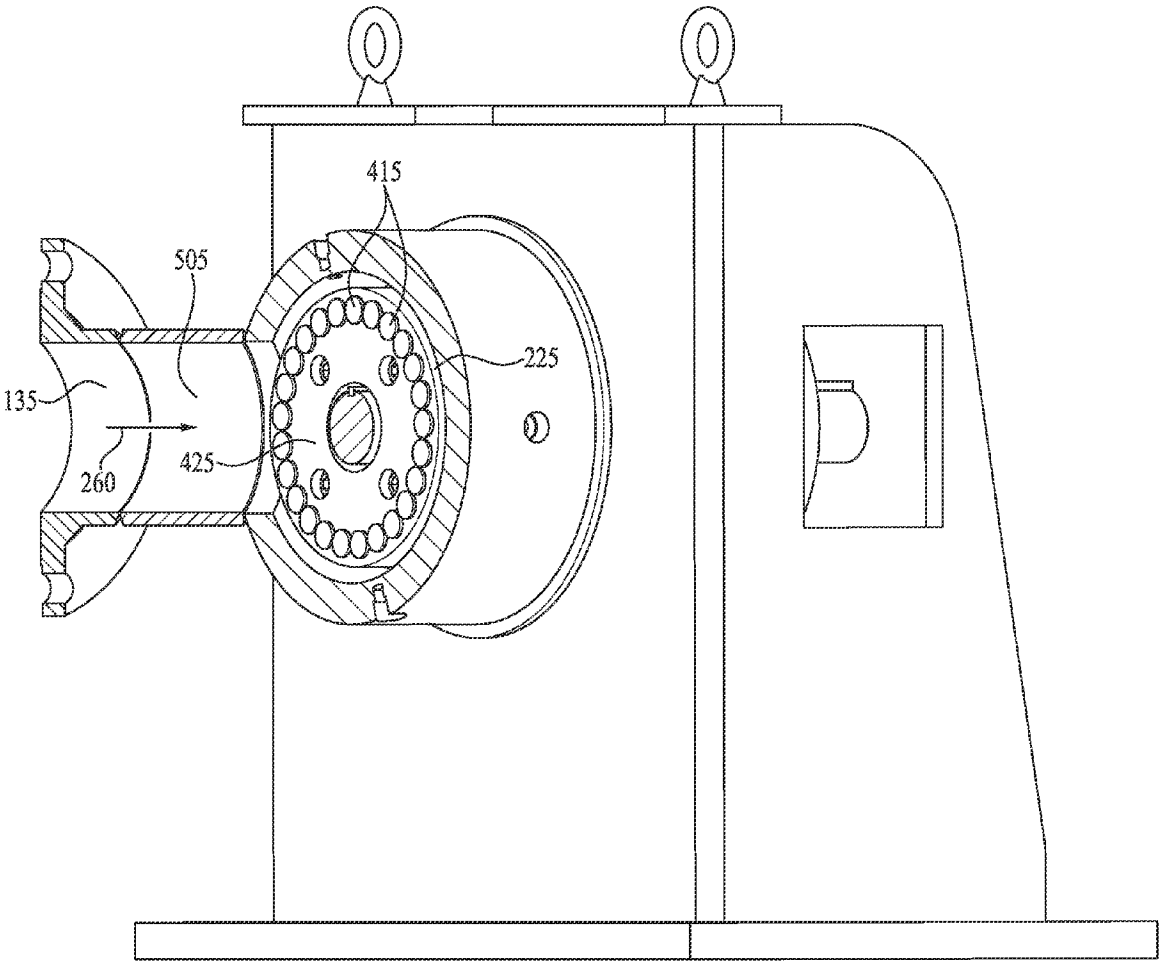
FIG. 13 is a cross-sectional view across line 13-13 of FIG. 4C of an intake of an illustrative embodiment.
Figure 20:
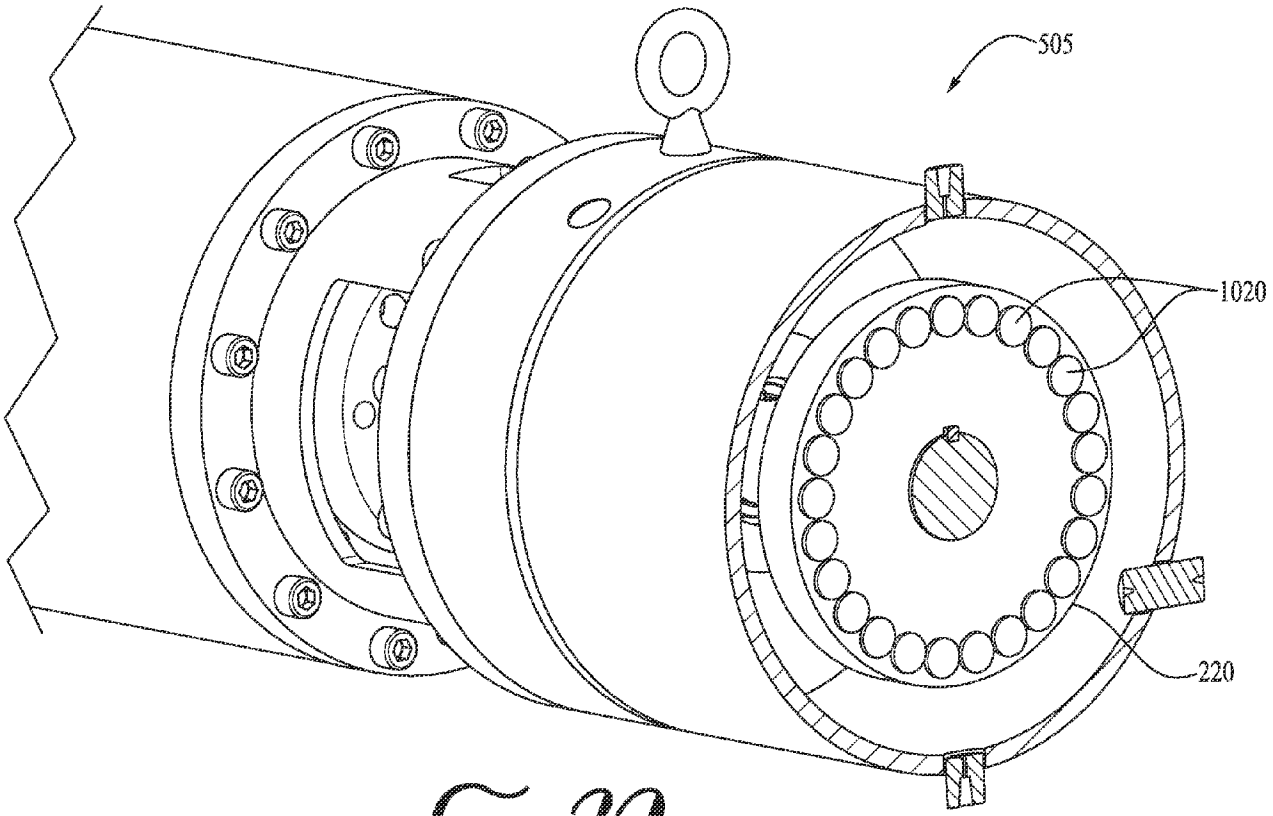
FIG. 20 is a cross sectional view across line 20-20 of FIG. 16 of an intake of an illustrative embodiment.
Figure 21:
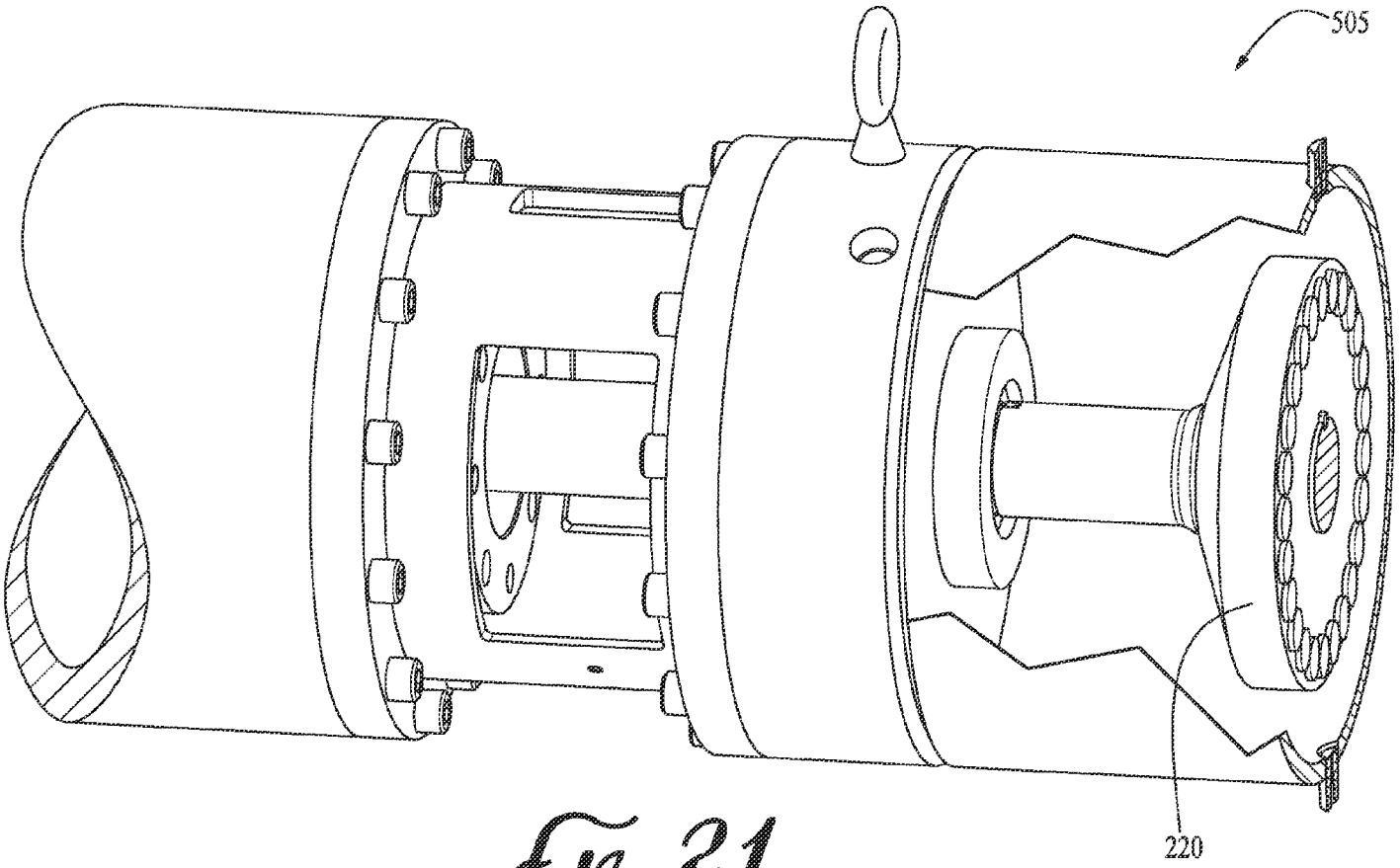
FIG. 21 is a cross sectional view across line 21-21 of FIG. 16 of an intake of an illustrative embodiment.

FIGS. 4B, 12 and 13 illustrate an exemplary stationary thrust bearing 225 secured within intake chamber 505 of horizontal surface pump assembly 100. Stationary thrust bearing 225 may be bolted into chamber base 240 to ensure stationary thrust bearing 225 does not substantially rotate. Chamber base 240 may be secured to intake chamber bracket 145 with chamber bolts 255. Intake chamber housing 1805 may similarly be secured to thrust chamber bracket 145 with bolts. In the illustrative embodiment of FIG. 12, twenty-five diamond-coated bearing pads 415, having a circular cross-sectional surface area are arranged circumferentially about bearing locking plate 425. Also as illustrated in FIG. 12, stationary thrust bearing 225 along with thrust runner 220 may be placed in the flow of pumped fluid 260 as the pumped fluid enters and/or flows through the intake 505 of illustrative embodiments. FIG. 13 illustrates a thrust bearing 225 of an illustrative embodiment braced within intake 505. FIGS. 20 and 21 illustrate thrust runner 220 keyed to shaft 200 within intake 505 of an illustrative embodiment.

Radial Support Bearings

Figure 14:
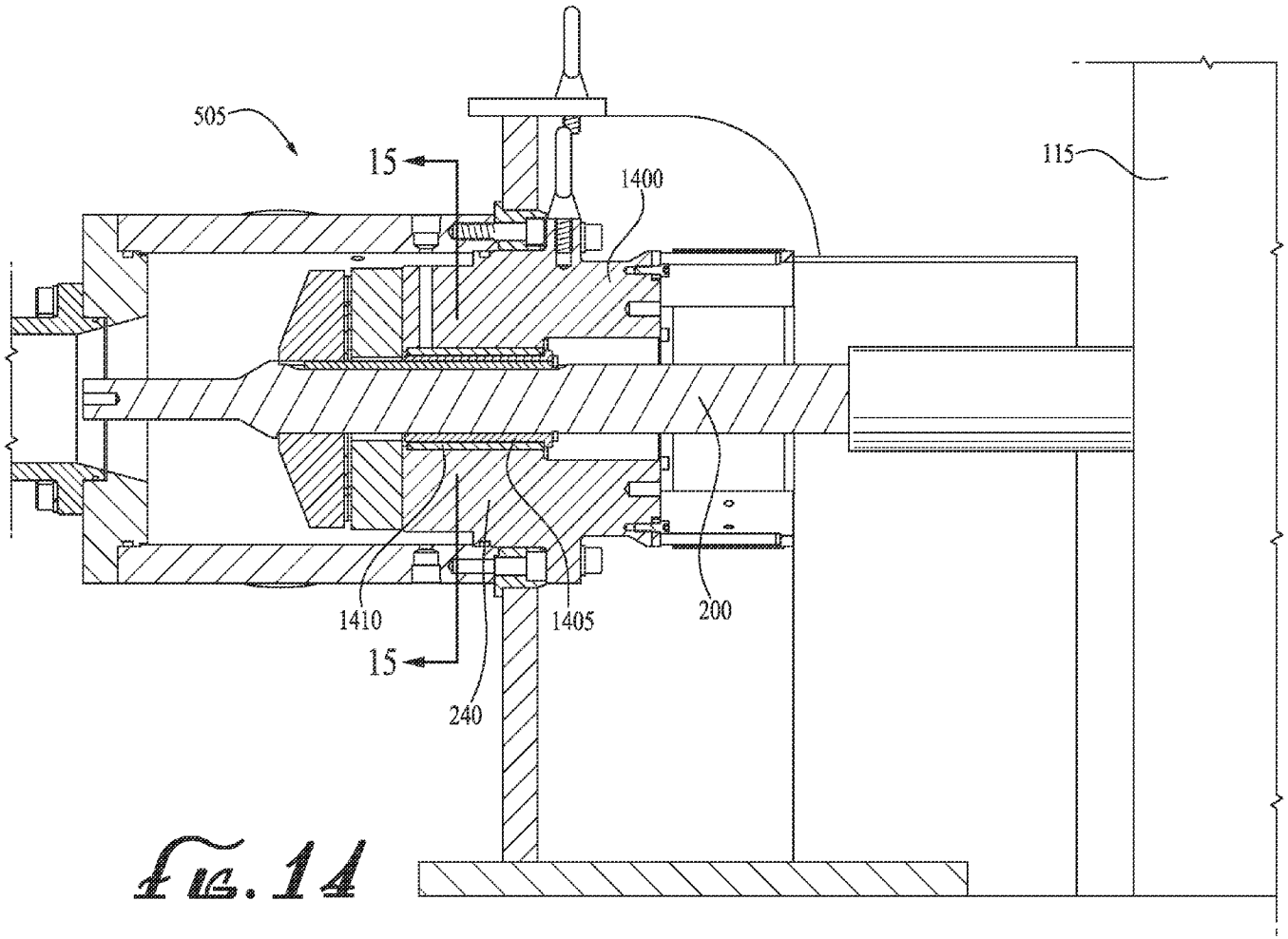
FIG. 14 is a cross-sectional view across line 14-14 of FIG. 3 of an intake of an illustrative embodiment.

One or more sets of radial support bearings may be included on intake shaft 200 of illustrative embodiments. Radial support bearings may, in addition to providing radial support, also provide upthrust support for assembly 100. FIGS. 4A, 4B and 14 illustrate an exemplary radial support bearing set located in intake 505. As shown in FIG. 14, radial support bearings may be placed about shaft 200 in between stationary thrust bearing 225 and motor 115 and/or between thrust bearing set 270 and motor 115. Sleeve 1405 may be keyed to shaft 200 and rotate with shaft 200 and/or may be held in place by a snap ring. Bushing 1410 maybe secured to the wall of chamber base 240 with an interference fit and remain stationary during rotation of shaft 200.

Figure 15:
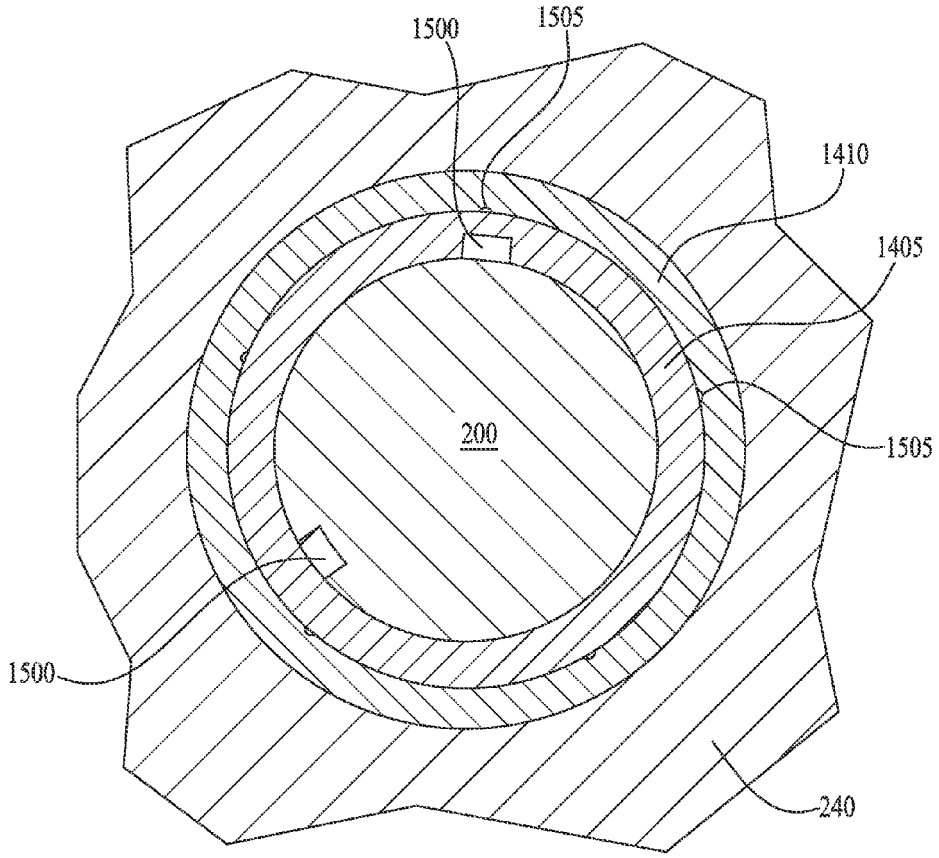
FIG. 15 is a partial cross-sectional view across line 15-15 of FIG. 14 of a radial support bearing of an illustrative embodiment.
Figure 10:
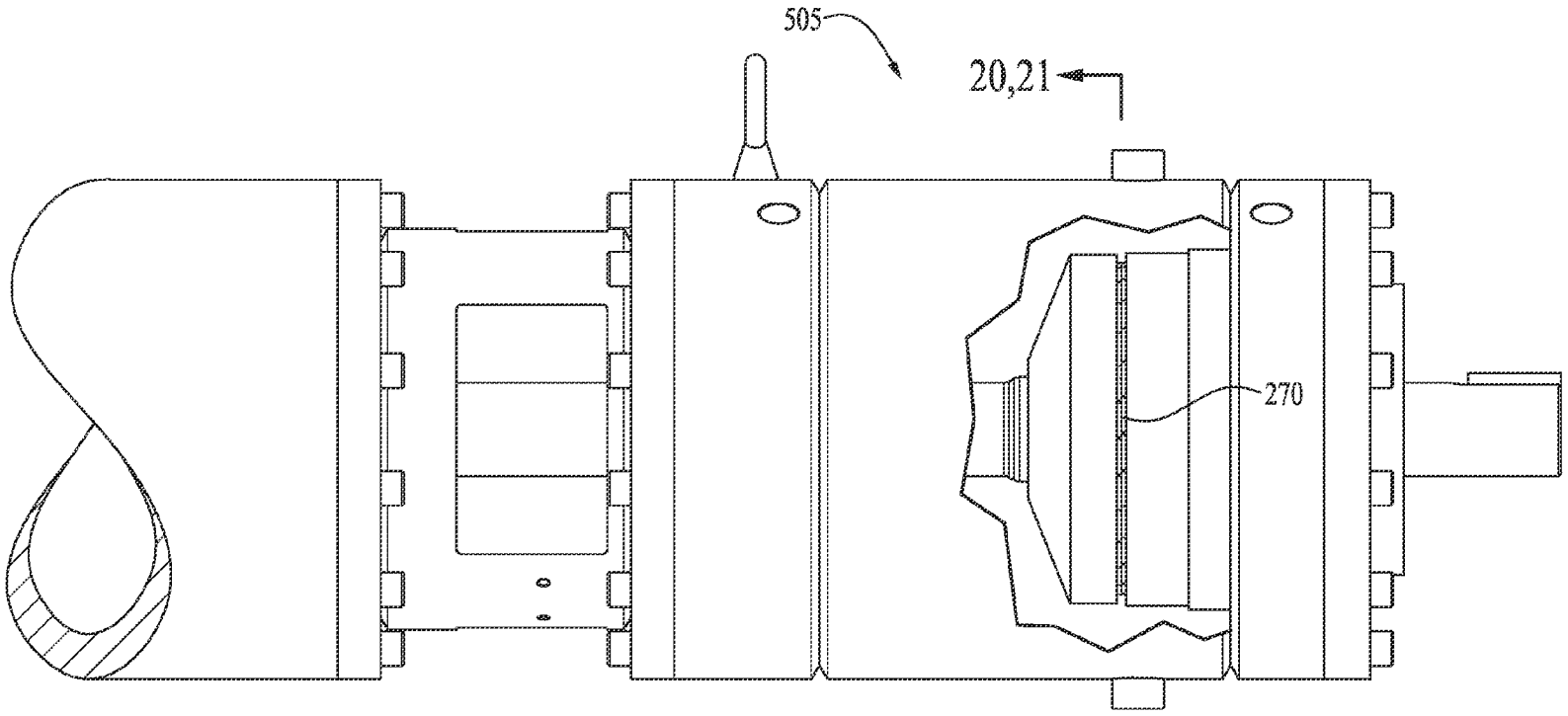

FIG. 15 is a partial cross sectional view across line 15-15 of FIG. 14. As illustrated in FIG. 15, bushing 1410 may secured to chamber base 240 with an interference fit. In some embodiments, bushing 1410 may be a compliant bushing. Sleeve 1405 may be keyed to shaft 200 at keyway 1500. Bushing 1410 may include grooves 1505 on an inner circumference to assist in guiding cooling and/or lubricating bypass fluid 280 between bushing 1410 and sleeve 1405. Grooves 1505 may extend longitudinally along the inner circumference of bushing 1410 and/or the outer circumference of sleeve 1405 to assist in guiding the flow of fluid around bushing 1410 and sleeve 1405.

Figure 17:
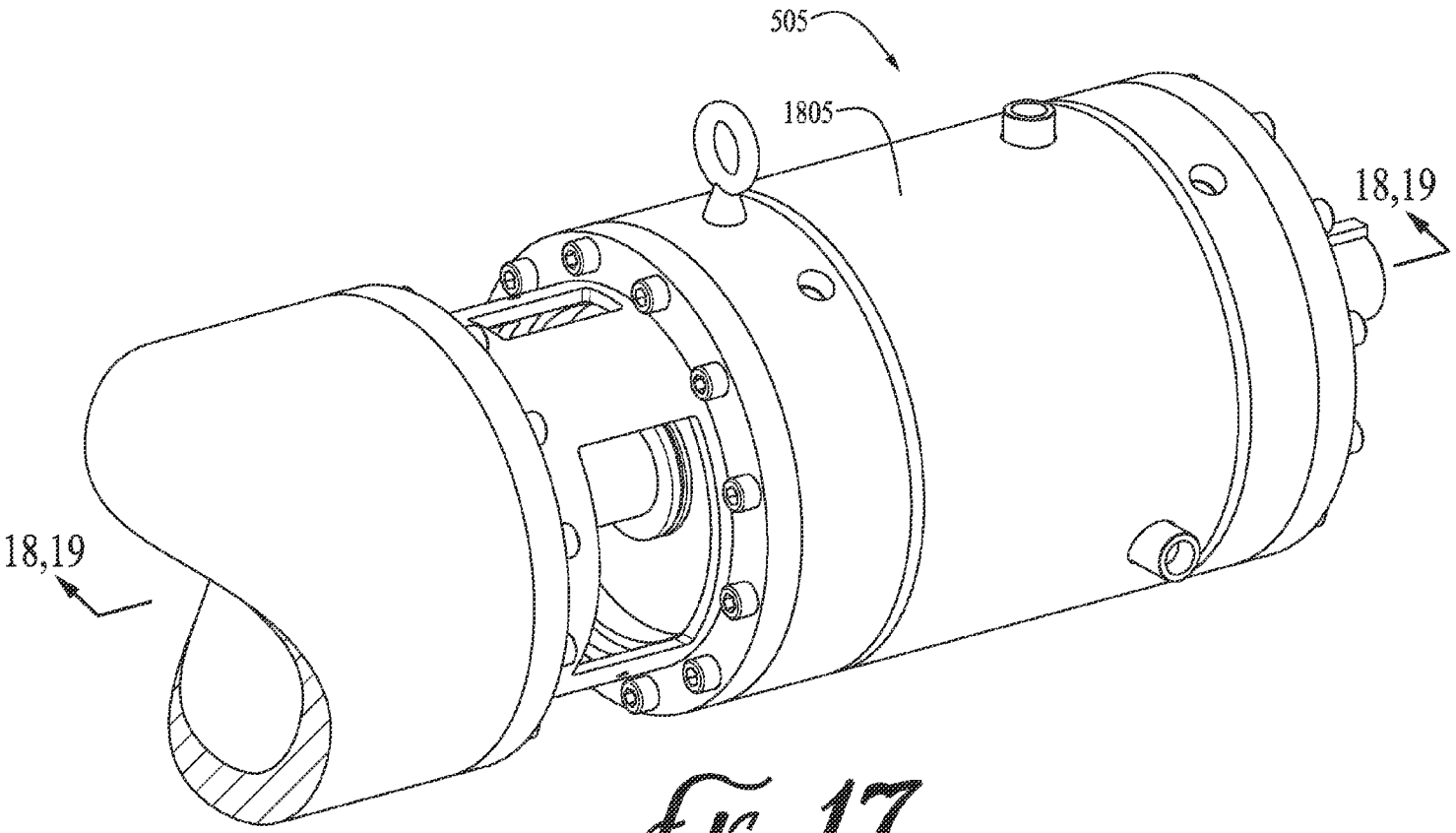
FIG. 17 is a perspective view of an intake of an illustrative embodiment.
Figure 18:
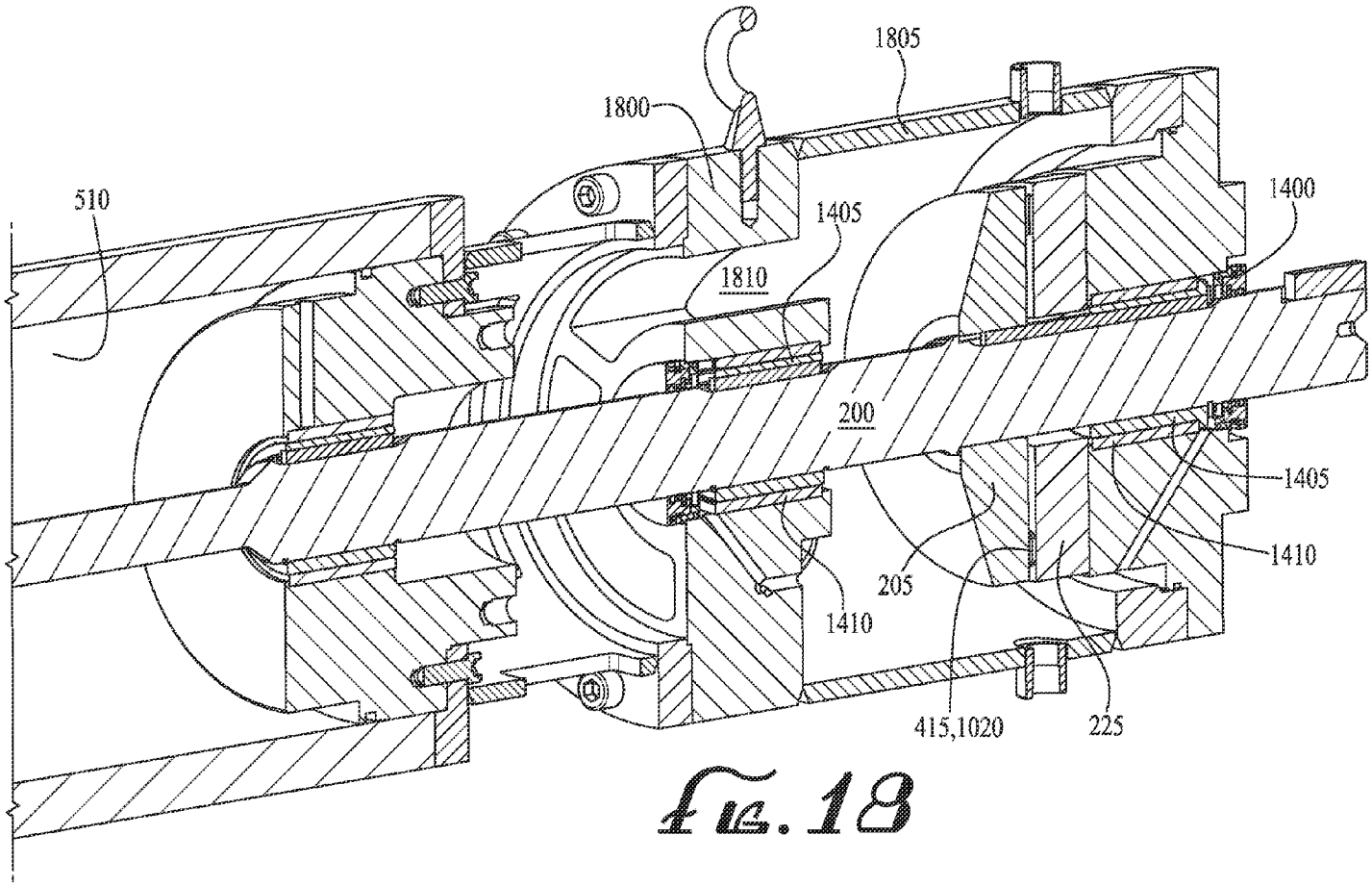
FIG. 18 is a cross sectional view across line 18-18 of FIG. 17 of an intake with dual radial support bearings of an illustrative embodiment.
Figure 19:
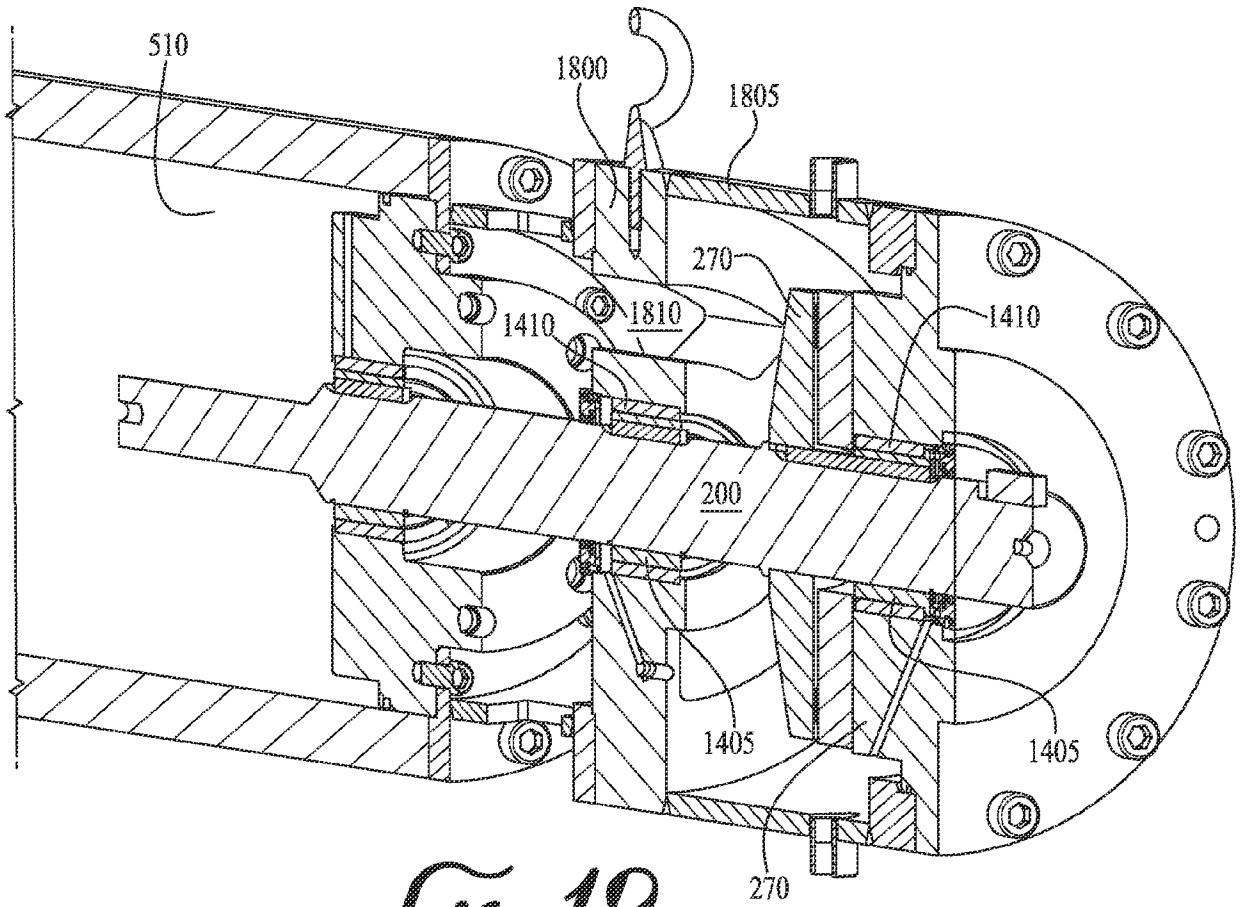
FIG. 19 is a cross sectional view across line 19-19 of FIG. 17 of an intake of an illustrative embodiment.

To provide additional radial support, for example to counteract vibrations, in certain embodiments a second set of sleeve 1405 and bushing 1410 may also be included on the pump side of intake chamber 505 as illustrated in FIGS. 17, 18 and 19. As shown in FIG. 18 and FIG. 19, in addition to a first sleeve 1405 and a first bushing 1410 in between bearing set 270 and motor 115, a second radial bearing set of a second sleeve 1405 and a second bushing 1410 may also be placed in between bearing set 270 and pump inlet 510. Spider bearing 1800 may be employed to brace bushing 1410 in a stationary fashion within housing 1805 of intake 505, and include fluid thruways 1810 to permit well fluid to pass through spider bearing 1800 and into pump inlet 510. As illustrated, spider bearing 1800 braces bushing 1410 in place within housing 1805. In some embodiments sleeve 1405 and bushing 1410 may be placed on the pump side of intake 115 rather than on the motor side, as an alternative to being additional to a bushing 1410 and sleeve 1405 of the motor side of intake 505.

Operation of the Pump

Illustrative embodiments include a method for absorbing the thrust of a horizontal surface pump assembly. Once pump assembly 100 has been positioned at the desired location, operation of the pump may be initiated. Unlike motor oil with extreme pressure additives, the pumped fluid may not provide boundary layer separation between faces 425, 1035 when ESP pump 125 is first started. This is predominantly due to the pumped fluid's relatively lower viscosity, the lack of additives in pumped fluid that would otherwise provide boundary layer lubrication and/or due to contaminants in the pumped fluid. Thus, pumped fluid would not typically be used as a hydrodynamic film in conventional pump assemblies. As a result of the lack of lubrication, thrust runner 220 and thrust bearing 225 must endure contact of the faces during start-up. Illustrative embodiments of thrust runner 220 and thrust bearing 225 are uniquely suited for this purpose. Diamond coat 600 may endure face to face contact of the thrust bearing 225 and thrust runner 220 of illustrative embodiments and prevent damage to thrust runner 220 and thrust bearing 225 prior to formation of the hydrodynamic film, due to the extreme hardness of diamond as employed in illustrative embodiments. Upon continued operation of ESP pump 125, a hydrodynamic film may form from pumped fluid between faces 425, 1035. Pumped fluid passing by the bearing set 270 during operation of the pump 125 may assist in keeping the bearings cool and preventing flaking of diamond coat 600 off of pads 415, 1020 and/or pad base 605. Thrust runner 220 and thrust bearing 225 may handle increased axial loads due to the pumped fluid's improved heat transfer rate over motor oil. In some embodiments, bearing runner 220 and thrust bearing 225 may handle loads of up to about 15,000 pounds, 18,000 pounds, 20,000 pounds, or 25,000 pounds.

The inventions described herein improve the thrust absorbing capabilities of horizontal surface pumps. The diamond coated faces of the bearings of illustrative embodiments allow the thrust bearings of illustrative embodiments to be placed closer to the pump, further from the hot motor, eliminate the need for the bearings to be placed in a cavity of clean oil and/or eliminate the need for a standalone thrust chamber. Use of pumped fluid to act as a hydrodynamic film between the bearings improves the heat and thrust handling capabilities of the bearings, improving the function of the pump assembly and increasing its lifespan. Illustrative embodiments may eliminate the need for a standalone thrust chamber and regular motor-oil changes. Other types of pump assemblies, such as vertical or horizontal downhole pumps or other pumps requiring improved thrust absorbing capabilities may benefit from the apparatus, system and method of illustrative embodiments.

While the invention herein disclosed has been described by means of specific embodiments and applications thereof, numerous modifications and variations could be made thereto by those skilled in the art without departing from the scope of the invention set forth in the claims. The foregoing description is therefore considered in all respects to be illustrative and not restrictive. The scope of the invention is indicated by the appended claims, and all changes that come within the meaning and range of equivalents thereof are intended to be embraced therein.

What is claimed is:

1. A thrust-absorbing horizontal surface pump assembly comprising:

a horizontally-mounted electric submersible pump (ESP pump), the ESP pump comprising a pump inlet;

a motor operatively coupled to the ESP pump so as to turn the ESP pump;

an intake chamber extending between the ESP pump and the motor, wherein the intake chamber comprises a fluid entrance and an intake shaft, wherein the intake shaft is rotatably coupled to a motor shaft on a first end and an ESP pump shaft on a second end;

a thrust bearing set disposed around the intake shaft, the thrust bearing set comprising:

a stationary thrust bearing secured to a chamber base of the intake chamber, the stationary thrust bearing comprising:

a first diamond-coated pad secured by a first locking plate; and a thrust runner paired with the stationary thrust bearing, wherein the thrust runner rotates with the intake shaft, the thrust runner comprising a second diamond-coated pad secured by a second locking plate;

the intake chamber further having an open cavity extending between the thrust runner and the pump inlet;

a first fluid path around the intake shaft and through the thrust bearing set, wherein a bypass fluid and a portion of a pumped fluid cool and lubricate the thrust bearing set; and a second fluid path from the fluid entrance through the open cavity to the pump inlet.

2. The horizontal surface pump of claim 1, wherein the stationary thrust bearing comprises a first plurality of first diamond-coated pads arranged circumferentially around the first locking plate and the thrust runner comprises a second plurality of second diamond-coated pads arranged circumferentially around the second locking plate.

3. The horizontal surface pump of claim 2, wherein a diamond-coated pad of each of the first and second plurality of diamond-coated pads has one of a circular, elliptical, quadrangular, or pie-shaped profile.

4. The horizontal surface pump of claim 2, wherein the stationary thrust bearing comprises an inner circumferential row of the first diamond-coated pads and an outer circumferential row of the first diamond-coated pads, and wherein each of the first diamond-coated pads in the inner circumferential row are positioned interstitially between two of the first diamond-coated pads in the outer circumferential row.

5. The horizontal surface pump of claim 3, wherein the thrust runner comprises an inner circumferential row of the second diamond-coated pads and an outer circumferential row of the second diamond-coated pads, and wherein each of the second diamond-coated pads in the inner circumferential row are arranged interstitially between two of the second diamond-coated pads in the outer circumferential row.

6. The horizontal surface pump of claim 1, wherein one of the first diamond-coated pad, the second diamond-coated pad or a combination thereof comprise leached diamond.

7. The horizontal surface pump of claim 1, wherein one of the first diamond-coated pad, the second diamond-coated pad or a combination thereof comprise a facing table of polycrystalline diamond.

8. The horizontal surface pump of claim 1, wherein the thrust runner comprises a runner base keyed to the intake shaft, and wherein the locking plate is secured to the runner base.

9. The horizontal surface pump of claim 1, wherein one of the first diamond-coated pad, the second diamond coated pad or a combination thereof has a disc-shaped profile.

10. The horizontal surface pump of claim 1, wherein the intake chamber further comprises a rotatable sleeve keyed to the intake shaft between the thrust bearing set and the motor, and a stationary bushing paired with the sleeve to form a radial support bearing set.

11. The horizontal surface pump of claim 10, wherein the stationary bushing comprises a plurality of lubrication grooves extending longitudinally along an inner circumference of the stationary bushing.

12. The horizontal surface pump of claim 10, wherein the thrust bearing set and the radial support bearing set are fluidly coupled by bypass fluid.

13. The horizontal surface pump of claim 12, wherein the bypass fluid is from a mechanical seal flush.

14. The horizontal surface pump of claim 10, further comprising a second radial support bearing set positioned between the thrust bearing set and the ESP pump, the second radial support bearing set comprising:

a second rotatable sleeve keyed to the intake shaft between the thrust bearing set and the electric submersible pump;

a second stationary bushing paired with the second sleeve;

and a spider bearing fixedly coupled between a housing of the intake chamber and the second stationary bushing.

15. The horizontal surface pump of claim 14, wherein the spider bearing comprises fluid pathways to permit flow of the pumped fluid through the spider bearing and then into the ESP pump.

16. A thrust-absorbing horizontal surface pump system comprising:

an intake chamber between a multi-stage centrifugal pump and an electric motor, wherein the intake chamber, multi-stage centrifugal pump and electric motor are horizontally aligned on a surface, and wherein the centrifugal pump moves a pumped fluid;

the intake chamber comprising an intake shaft extending longitudinally through the intake chamber and coupled to an electric motor shaft and a multi-stage centrifugal pump shaft, the intake chamber further comprising:

a thrust bearing set comprising a stationary thrust bearing and a rotatable thrust runner, wherein a first face of the stationary thrust bearing positioned towards the rotatable thrust runner is at least partially diamond-coated, and wherein a second face of the rotatable thrust runner positioned towards the stationary thrust bearing is at least partially diamond-coated; and a fluid entrance that receives the pumped fluid into the intake chamber;

a pump inlet that receives the pumped fluid into the multi-stage centrifugal pump;

an open cavity in the intake chamber extending between the thrust runner and the pump inlet;

a first fluid path passing around and through the thrust bearing set before reaching the pump inlet; and a second fluid path passing through the open cavity to the pump inlet.

17. The horizontal surface pump system of claim 16, wherein the first face has a first plurality of diamond-coated pads, and the first plurality of diamond-coated pads are circumferentially dispersed about the first face, and wherein the second face has a second plurality of diamond-coated pads, and the second plurality of diamond-coated pads are circumferentially dispersed about the second face.

18. The horizontal surface pump system of claim 17, wherein the first plurality of diamond-coated pads are dispersed about a first locking member secured to a first base, and the second plurality of diamond coated pads are dispersed about a second locking member secured to a second base.

19. The horizontal surface pump system of claim 16, wherein one of the rotatable thrust runner, the stationary thrust bearing, or a combination thereof comprises a first plurality of diamond-coated pads arranged in an inner circumferential row and a second plurality of diamond-coated pads arranged in an outer circumferential row, and wherein each of the first diamond-coated pads in the inner circumferential row is arranged interstitially between two of the second diamond-coated pads in the outer circumferential row.

20. The horizontal surface pump system of claim 19, wherein each diamond-coated pad of the first plurality of diamond-coated pads has a smaller diameter than each diamond-coated pad of the second plurality of diamond-coated pads.

21. The horizontal surface pump system of claim 16, wherein the rotatable thrust runner is keyed to the intake shaft.

22. The horizontal surface pump system of claim 16, wherein the first face and second face each comprise a single diamond-coated pad having a disc-shaped profile.

23. The horizontal surface pump system of claim 16, further comprising a radial support sleeve keyed to the intake shaft between the thrust bearing set and the pump inlet.

24. The horizontal surface pump system of claim 23, further comprising a radial support bushing paired with the radial support sleeve.

25. The horizontal surface pump system of claim 24, further comprising a spider bearing securing the radial support bushing within an intake chamber housing, wherein openings in the spider bearing define a thruway for the first portion of the pumped fluid to flow through the spider bearing.

* * * * *